US010874264B1

(12) United States Patent
Porzio

(10) Patent No.: US 10,874,264 B1
(45) Date of Patent: Dec. 29, 2020

(54) APPARATUS FOR STORAGE OF BATHROOM ACCESSORIES

(71) Applicant: Richard Porzio, San Jose, CA (US)

(72) Inventor: Richard Porzio, San Jose, CA (US)

( * ) Notice: Subject to any disclaimer, the term of this patent is extended or adjusted under 35 U.S.C. 154(b) by 89 days.

(21) Appl. No.: 15/917,581

(22) Filed: Mar. 10, 2018

Related U.S. Application Data

(63) Continuation-in-part of application No. 15/236,966, filed on Aug. 15, 2016, now Pat. No. 10,646,078.

(60) Provisional application No. 62/213,178, filed on Sep. 2, 2015.

(51) Int. Cl.

| | |
|---|---|
| ***A47K 17/00*** | (2006.01) |
| ***A47K 10/22*** | (2006.01) |
| ***B65D 83/00*** | (2006.01) |
| ***B65D 25/04*** | (2006.01) |
| ***B65D 85/00*** | (2006.01) |
| ***B65D 51/28*** | (2006.01) |
| ***B65D 43/16*** | (2006.01) |
| *B65F 1/14* | (2006.01) |
| *A47K 11/00* | (2006.01) |

(52) U.S. Cl.
CPC ..... *A47K 10/22* (2013.01); *B65D 25/04* (2013.01); *B65D 43/163* (2013.01); *B65D 51/28* (2013.01); *B65D 85/70* (2013.01); *A47K 11/00* (2013.01); *A47K 17/00* (2013.01); *B65F 1/14* (2013.01)

(58) Field of Classification Search
CPC ... A46B 17/00; A46B 2200/304; A47B 67/00; A47B 67/02; A47B 96/00; A47K 10/22; A47K 10/18; A47K 11/10; A47K 17/00; A47K 2010/3253; B65D 51/28; B65D 85/70; B65D 85/00; B65D 25/04; B65D 43/163; B65F 1/004; B65F 1/1608; B65F 1/1426; B65F 1/16; G06F 1/1628
USPC ..... 206/349, 225, 394, 457, 206, 361, 581, 206/209; 312/42, 45, 207, 72, 206, 312/140.1, 140.2, 140.3, 140.4, 286, 2, 312/90, 283, 313; 4/255.11; 220/521, 220/503, 500, 826; D4/116; D6/523, D6/525, 526, 551; 15/257.01, 257.1, 264, 15/260
See application file for complete search history.

(56) References Cited

U.S. PATENT DOCUMENTS

| | | | | |
|---|---|---|---|---|
| 1,470,199 | A * | 10/1923 | Small | A47J 27/13 220/573.5 |
| 2,780,509 | A * | 2/1957 | Gleitsman | D06F 95/002 312/201 |
| 2,814,542 | A * | 11/1957 | Gleitsman | D06F 95/002 312/201 |
| 2,870,932 | A * | 1/1959 | Davis | A01K 97/05 220/521 |
| D201,099 | S * | 5/1965 | Brillante | D6/520 |

(Continued)

*Primary Examiner* — Gideon R Weinerth
(74) *Attorney, Agent, or Firm* — Richard E. Ballard

(57) ABSTRACT

An apparatus for storage of toiletries and other bathroom accessories may include a main body, an upper compartment assembly, and a base. The main body may include an outer wall defining a central cavity configured and dimensioned to store toilet paper, and a dividing wall separating the central cavity from a plunger storage area defined by a frame and the base. The upper compartment assembly may include one or more compartments for storing toiletries, and the apparatus may further include one or more for storing air freshener, extra wipes, and/or other accessories.

9 Claims, 29 Drawing Sheets

(56) References Cited

U.S. PATENT DOCUMENTS 3,429,474 A * 2/1969 Roosevelt ..... A47K 17/00 220/555
3,573,879 A * 4/1971 Bergkamp ..... A47L 13/51 280/47.19
3,845,858 A * 11/1974 Jenkins ..... B65D 83/00 206/233
4,008,933 A * 2/1977 Wanek ..... A47K 10/22 312/206
4,432,451 A * 2/1984 Hooser ..... A47K 10/22 206/216
5,065,886 A * 11/1991 Sher ..... B65D 43/14 206/0.5
5,114,006 A * 5/1992 Wilk ..... B65D 81/36 206/349
5,244,220 A * 9/1993 Cortez ..... B62B 1/12 248/127
D374,584 S * 10/1996 Freeman ..... D6/519
D411,676 S * 6/1999 Cantrell ..... D34/5
5,984,100 A * 11/1999 Ramsey ..... A47K 17/00 206/361
6,109,429 A * 8/2000 Cunningham ..... A47K 17/00 206/15.2
6,138,558 A * 10/2000 Harrington ..... B30B 9/323 100/102
6,193,059 B1 * 2/2001 Massaro ..... A47K 10/22 206/15.3
6,729,470 B2 * 5/2004 Watlington ..... A47K 17/00 206/349
7,222,747 B1 * 5/2007 Savran ..... A47K 10/38 221/34
8,938,822 B2 * 1/2015 Eleftheriou ..... E03D 9/06 4/353
9,326,650 B2 * 5/2016 Wisdom ..... E03D 11/00
10,646,078 B1 * 5/2020 Richard ..... B65D 51/28
2002/0027402 A1 * 3/2002 Hanser ..... A47K 17/00 312/206
2008/0029415 A1 * 2/2008 Wang ..... B65F 1/14 206/361
2008/0136130 A1 * 6/2008 Washington ..... B62B 1/14 280/47.17
2008/0197030 A1 * 8/2008 Wang ..... B65F 1/14 206/216
2009/0152132 A1 * 6/2009 Wang ..... A47K 11/10 206/15.3
2009/0211926 A1 * 8/2009 Wang ..... A46B 17/02 206/15.3
2014/0076757 A1 * 3/2014 Fredankey, Sr. ..... A47K 17/00 206/361
2014/0216957 A1 * 8/2014 Orozco ..... A47B 81/005 206/216
2014/0251844 A1 * 9/2014 Michelson ..... A47L 13/10 206/362.3
2016/0000281 A1 * 1/2016 Butts ..... A47K 17/00 206/581
2018/0127204 A1 * 5/2018 Smyth ..... B65F 7/00
2018/0140144 A1 * 5/2018 Music ..... A47K 17/00

* cited by examiner

APPARATUS FOR STORAGE OF BATHROOM ACCESSORIES

CROSS REFERENCE TO RELATED APPLICATIONS

This application is a continuation-in-part of U.S. application Ser. No. 15/236,966, filed Aug. 15, 2016 and titled "Apparatus for Storage of Bathroom Accessories", which claims benefit under of U.S. Provisional Application Ser. No. 62/213,178 filed on Sep. 2, 2015 and titled "Apparatus for Storage of Bathroom Accessories", which applications are incorporated by reference herein in their entireties.

TECHNICAL FIELD

The disclosed embodiments relate generally to storage devices, and in particular to apparatus for storing toilet paper and other bathroom accessories.

SUMMARY

Described herein are apparatus and methods for storing bathroom accessories. In an example embodiment, an apparatus for storing bathroom accessories may include a main body configured and dimensioned for storing toilet paper in a main body compartment and a rear tray area for storing a plunder and/or brush. In some embodiments, an upper compartment assembly may be secured at a top end of the body and may include a number of different compartments for storing bathroom accessories such as wipes, sanitary napkins, air freshener, and other toiletries or accessories.

In some embodiments, the upper compartment assembly may include a front compartment body and a front lid defining a front compartment, and a rear lid covering a rear compartment defined at least in part by a dividing member. The body may further include a central storage compartment defined at least in part by a front wall, a dividing member, and the front compartment body of the upper compartment assembly.

In some embodiments, the main body may include the front wall, a frame, and the dividing member disposed between the frame and the main wall, wherein said dividing member includes a substantially vertical rear wall portion that defines a rear wall of the central storage compartment and a substantially horizontal portion that defines a bottom of the central storage compartment.

In an example embodiment, an apparatus for storage of toiletries and other bathroom accessories may include a body, a lid, and a removable base. The body may include an outer wall defining a central cavity configured and dimensioned to store a toilet plunger and a toilet paper holder, and the lid may be configured to include a compartment for storing sanitary wipes for easy access through a slot in the top of the lid. The toilet paper holder may include a sleeve configured and dimensioned to fit over the handle of a plunger stored within the body, and a lower stop or flange member adapted to support a stack of one or more toilet paper rolls disposed over the sleeve, such that removal of the holder removes the stack of toilet paper from the storage device and provides access to the plunger. The base of the storage device may be adapted to support a plunger, e.g., with a grate, baffles or other support surface designed to hold water and particles or other debris that may fall from the plunger, and may be removed from the body for easy cleaning. The body of the storage device may also include one or more compartments for storing air freshener, extra wipes, and/or other toiletries or accessories.

In some embodiments, a top compartment is formed into an upper portion of the back wall of the storage device (or, for example within a portion of the lid), and may be configured and dimensioned to hold a bottle, tube or other dispenser, e.g., for holding and/or dispensing air freshener. In some embodiments, one or more additional compartments may be formed within or adjacent to a back or side wall of the device, e.g., for storing extra wipe packets or other accessories, each of which may be accessible through a corresponding slot, door or other access feature integrated within or otherwise associated with each compartment. In some embodiments, a bathroom storage device is adapted to attached one or more external caddies, cradles, holders, or other devices to the outside of the body or lid, e.g., for storing air freshener, reading material, cell phone, wipes, tissues, sanitary pads, tampons, or other toiletries or bathroom accessories.

In some embodiments, the wall of the body may include one or more body compartments, each body compartment having an access feature for accessing stored items. Such access feature may be, for example, a slot, a hatch, a door, or any other feature for accessing items stored in a compartment. In some embodiments, an apparatus may further include a lid adapted to attach to a top end of the body, and the lid may include a compartment configured and dimensioned to hold and dispense wipes.

In some embodiments, apparatus herein may include one or more cradles, holders, or caddies (collectively, referred to as caddies) for storing various toiletries and/or bathroom accessories. In some embodiments, such accessories may include air freshener, cell phone, e-book, book, magazine, music player, speaker, tissues, tampons, sanitary napkins, cigarettes, matches, perfume, or toiletries. In some embodiments, a caddy may include one or more hooks for hanging the caddy from the device. For example, the body may include one or more attachment members for attaching the one or more caddies, for example one or more slots or holes or similar features (collectively referred to as "slots") configured to receive hooks on each caddy such that the caddy may suspended from or otherwise attached to the body.

These as well as other aspects and advantages will become apparent to those of ordinary skill in the art by reading the following detailed description, with reference where appropriate to the accompanying drawings. Further, it should be understood that the embodiments described in this overview and elsewhere are intended to be examples only and do not necessarily limit the scope of the invention.

BRIEF DESCRIPTION OF THE DRAWINGS

Example embodiments are described herein with reference to the drawings.

Like reference numerals refer to the same or similar components throughout the several views of the drawings.

DESCRIPTION OF EMBODIMENTS

I. Overview

Described herein are apparatus and methods for organizing accessories in a bathroom. In the following description, for purposes of explanation, numerous examples and specific details are set forth in order to provide a thorough understanding of the aspects of the systems and methods. It will be evident, however, to one skilled in the art that the present invention as defined by the claims may include some or all of the features in these examples alone or in combination with other features described below, and may further include modifications and equivalents of the features and concepts described herein.

III. Example Embodiments

Figure 1:
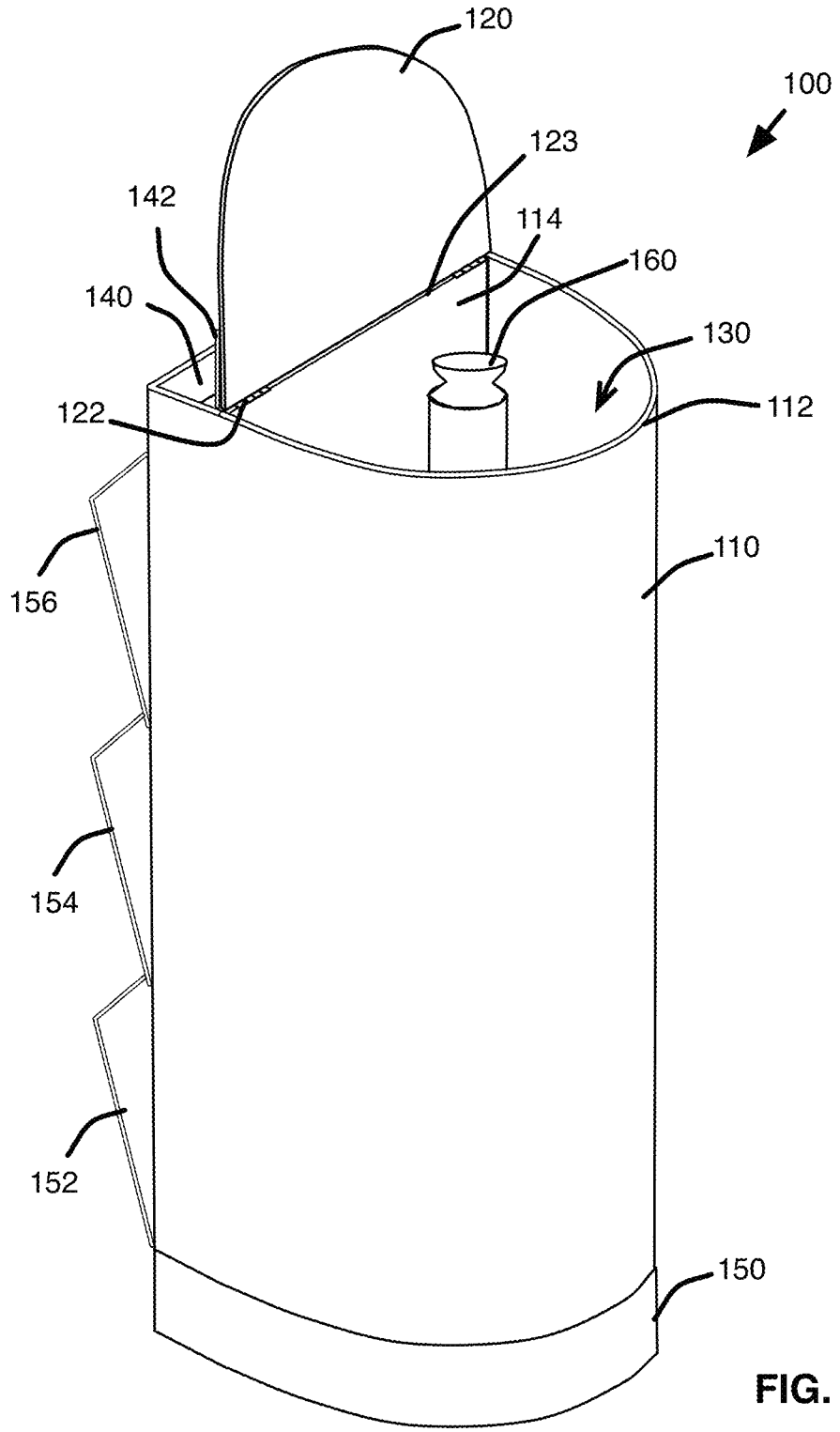
FIG. 1 is a perspective view schematic illustration of a bathroom accessory storage device according to an example embodiment.

Referring to FIG. 1, a bathroom accessory storage device 100 according to an example embodiment includes a body 110 and a base 150. Body 110 may include a wall 112, 114 surrounding a central cavity 130 configured and dimensioned to hold a plunger (not shown) and a TP holder 160 disposed over a handle of the plunger. In this embodiment, the wall includes a front portion 112 (also referred to herein as "front wall 112") and a rear or back portion 114 (also referred to herein as "back wall 114). One or more lids 120, 142 may be configured to cover the cavity 130 and/or one or more top compartments 140. In some embodiments, lids 120 and/or 142 may be hingably secured to body, e.g., by one or more hinges 122. In some embodiments, body 110 includes a top compartment 140, e.g., for storing air freshener or other bathroom accessories. One or more access features, e.g., doors 152, 154, 156, may be disposed on a back side of the body 110, e.g., to provide access to storage compartments integrated within the wall 114 of body 110. In some embodiments, wall 114 may include one or more compartments configured and dimensioned to store extra sanitary wipes or other toiletries or accessories, and each such compartment may be accessed using access features 152, 154, 156, or 142 (where 142 may be a rear lid for accessing a top compartment 140 integrated within the body 110).

In some embodiments, example storage devices described herein, e.g., storage devices 100 and/or 1700 (FIG. 17A), may be constructed of any desired materials, for example, plastic (e.g., polyethylene, polypropylene, polystyrene and polyvinyl chloride), polymer, metal, stainless steel, composites, or any combinations thereof.

Figure 2:
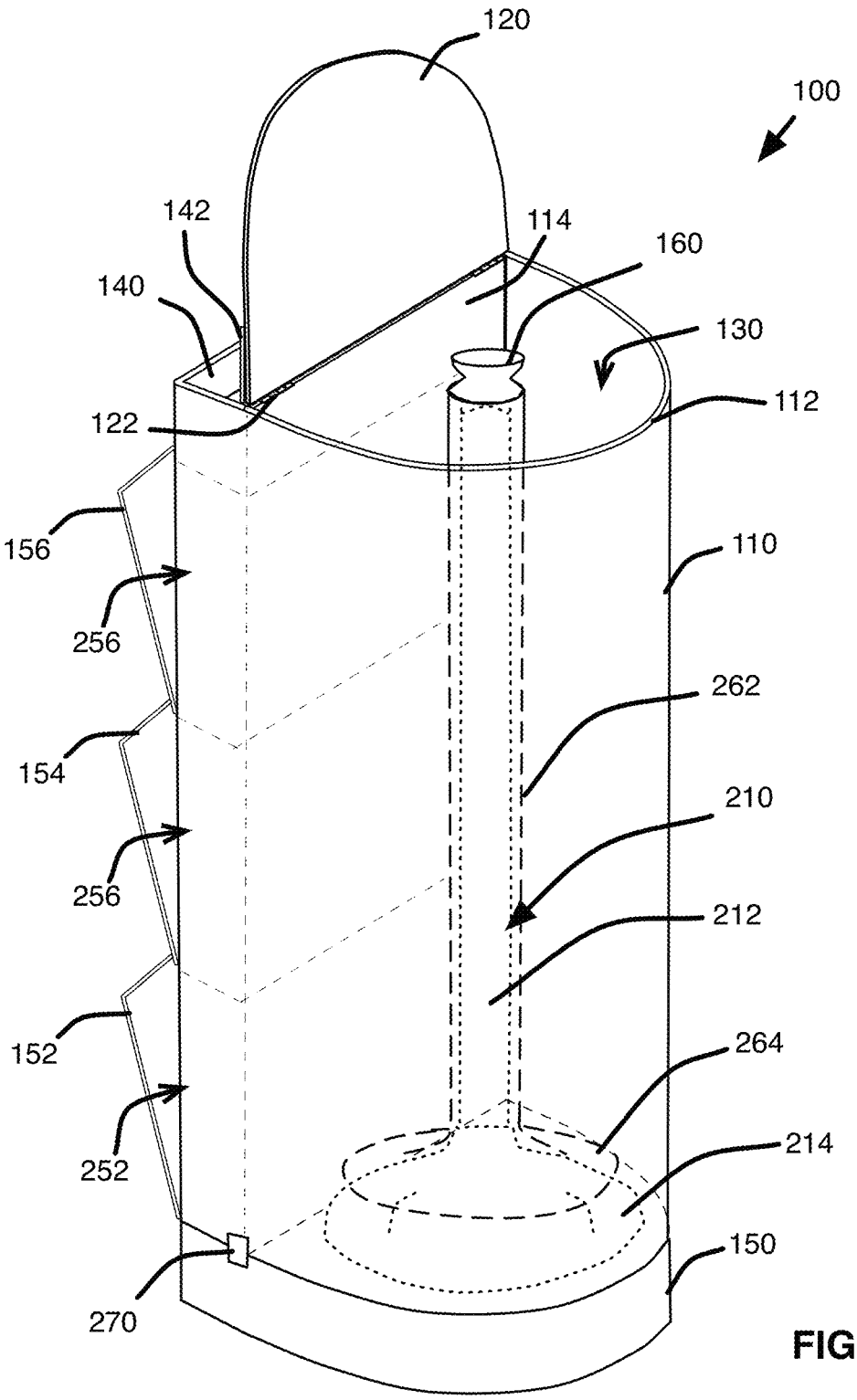
FIG. 2 is a perspective view schematic illustration of the example device of FIG. 1, with dashed lines showing rear storage compartments and example internal elements.

Turning now to FIG. 2, an example embodiment of device 100 is shown with dashed lines indicating internal elements that may be integrated and/or used in conjunction with device 100. For example, a plunger 210 may be disposed within the central cavity 130, for example a plunger having a head 214 and an elongated handle 212 attached to and extending from the head, such that a head 214 of plunger 210 rests on the base 150 and handle is positioned substantially axially within the cavity 130. TP Holder 160 may comprise a substantially cylindrical sleeve 262 configured and dimensioned to slide over handle 212, and a distal stop member, or flange 264 that extends laterally from the long axis of the sleeve 262. Sleeve 262 of the TP holder 160 is dimensioned such that plunger handle 212 may fit within the sleeve, and one or more rolls of toilet paper may fit over the sleeve and stack within the cavity 130. Flange 264 may serve as a stop for the bottom roll of toilet paper in the stack, such that lifting the TP holder off of the plunger handle 212 pulls the roll of toilet paper out of the central cavity 130.

In some embodiments, a rear portion of the body may include one or more compartments 252, 254, 256, each of which may be configured to store accessories. One or more access doors 152, 154, 156 may be hingably or otherwise attached to facilitate access to the compartments and to close the compartments to retain contents. In some embodiments, each of the one or more compartments 252, 254, 256 may include a slot or opening (e.g., in addition to or instead of access panels or doors 152, 154, 156) to provide access for storing and/or retrieving items in the corresponding compartment(s).

One skilled in the art will appreciate that the exact number, size, and placement of the compartments and other features of the device 100 (and/or similar features of other example devices 300, 600), including for example the size of body 110, cavity 130, and holder 160, may be modified without departing from the scope of the present invention(s).

In some embodiments, base 150 may be detachable from body 110, and may be selectively secured by one or more fasteners 270, which may include any desired device or devices for aligning and/or securing base 150 to the body 110 (e.g., one or more tabs, rims, latches, clips, or the like).

In some embodiments, body 110 may include a front wall 112 and a back wall 114 that define central cavity 130. In some embodiments, one or both of walls 112, 114 may be curved, e.g., approximately circular or semicircular in cross section or otherwise arched or curved to accommodate one or more rolls of toilet paper disposed within the cavity 130. One or more lids 120, 142 may be hingably secured to or near a top edge 123 of the body, e.g., at edge 123 of rear wall 114. In some embodiments, a top compartment 142 may be configured and dimensioned to store toiletries or accessories, e.g., an air freshener spray bottle or other desired accessory or accessories, and may be covered by a lid, e.g., lid 142 as shown in FIG. 2. In some embodiments, one or both lids 120, 142 may attach to body by one or more hinges 122. In other embodiments, one or more lids or covers may rest on body and/or may secure by other means, including without limitation hinges, snaps, slides, guides, clips, or any other devices or features for removably or hingably attaching a lid or cover to the top of the body 110.

Figure 3:
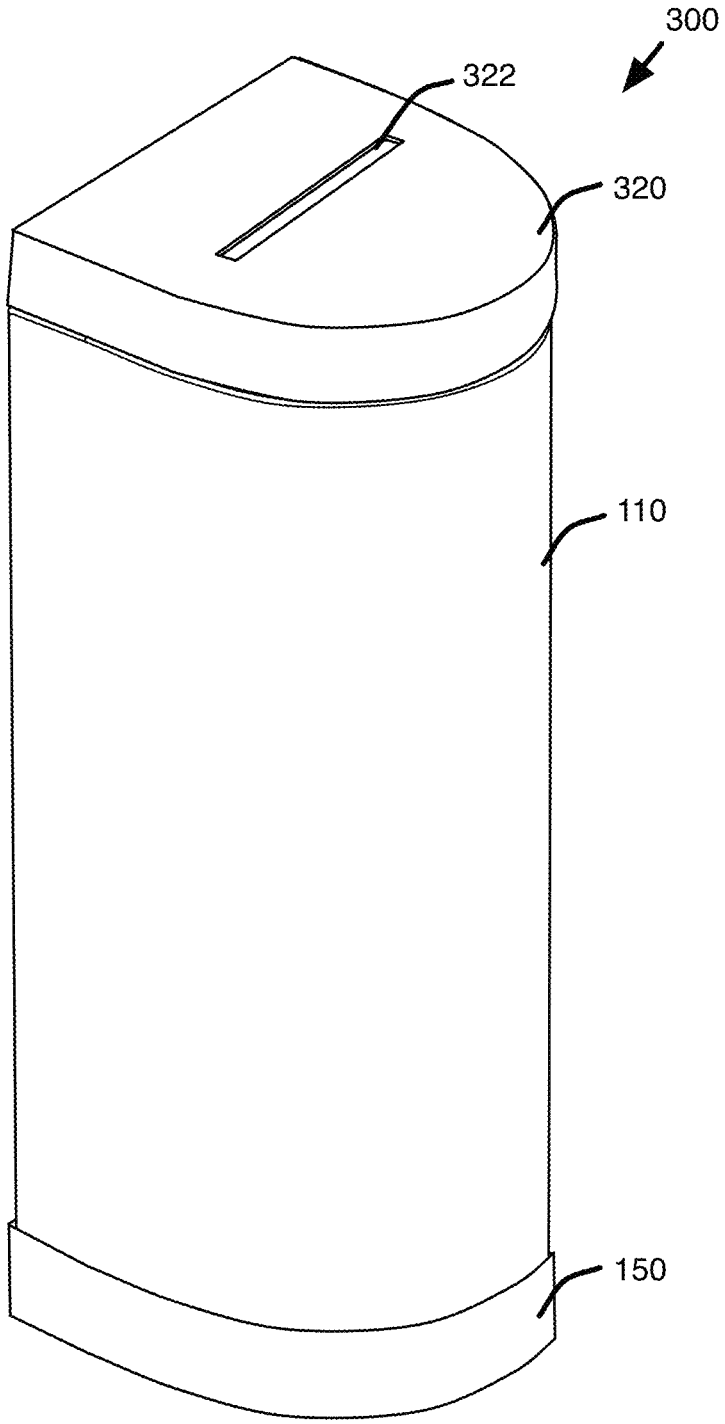
FIG. 3 is a perspective view schematic illustration of a bathroom accessory storage device according to an example embodiment, including a lid with wipe compartment.

Turning now of FIG. 3, another embodiment of a storage device 300 may include a body 110 and base 150 as described above, but may also include a lid 320 configured and dimensioned to store wipes, tissues or other items. In some embodiments, lid 320 may include one or more access features to access stored items, for example a slot 322 for easy removal of wipes or tissues. In some embodiments, lid 320 and/or body 110 may include one or more hingable, slidable, removable, or open access features, for example, slots, doors, lids, covers or other features for covering and/or accessing one or more items stored within the lid 320 or body 110. In some embodiments, lid 320 may include an opening or slot 322 and one or more doors on the top, bottom, or side of the lid 320 to access air freshener or other items stored in one or more compartments within the lid.

Figure 4:
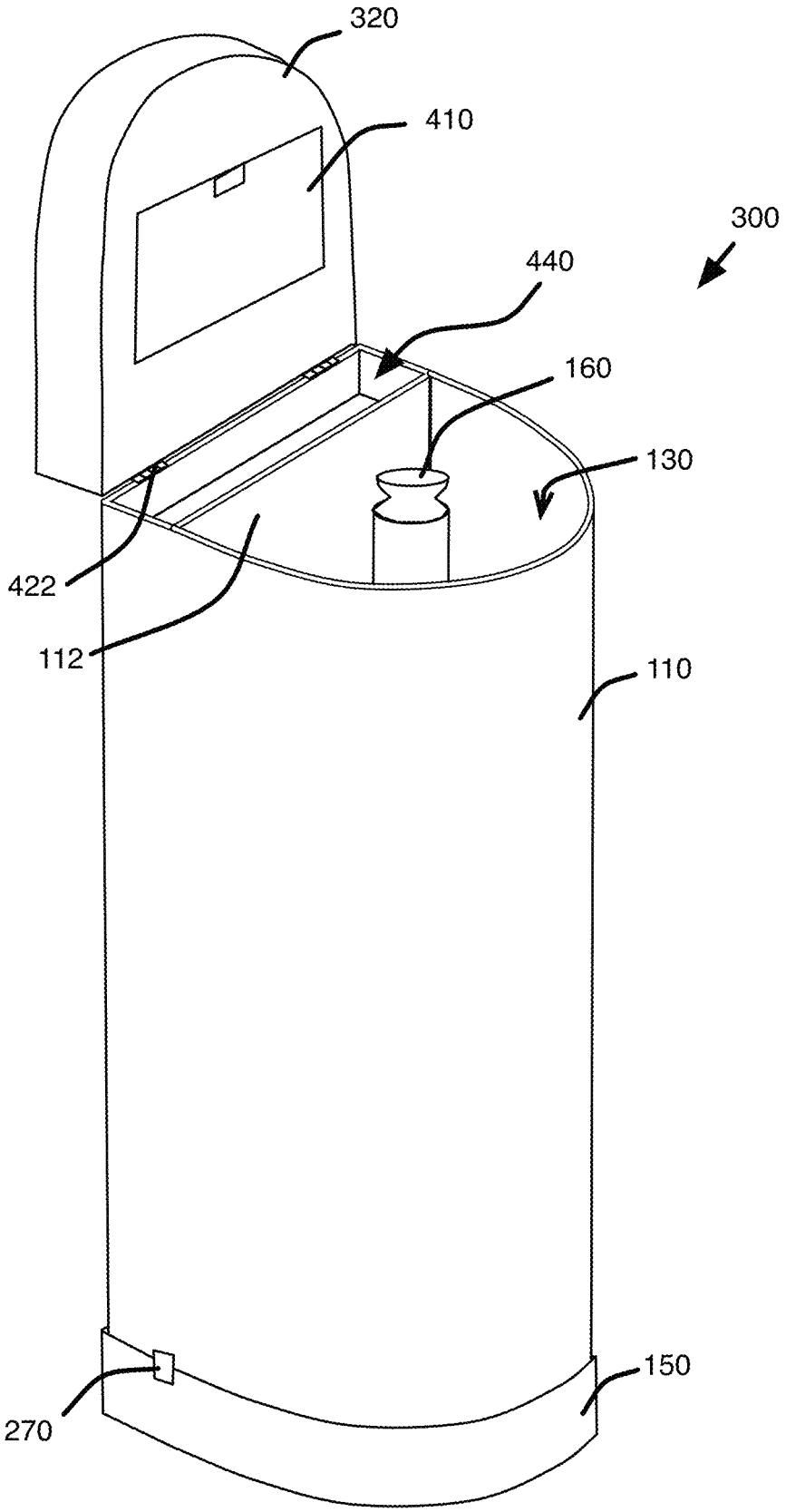
FIG. 4 is a perspective view schematic illustration of the bathroom accessory storage device of FIG. 3, showing the lid open and internal compartments within the lid and body.

As shown in FIG. 4, lid 320 of device 300 may include a compartment 410 for accessing an inner cavity within lid 320, e.g., for holding wipes or tissues to be dispensed from the slot 322 shown in FIG. 3. In some embodiments, a rear or top compartment 440 may be accessed with lid 320 opened, and may be configured to hold an air freshener spray, e.g., a pump or aerosol spray container for manually dispensing air freshener. In some embodiments, compartment 440 may be configured and dimensioned to hold other desired accessories. One or more hinges 422 may be used to hingably secure lid 320 to an upper rear edge of body 110, e.g., as shown in FIG. 4 or as otherwise desired.

In some embodiments, body 110 of device 300 may fit on or within base 150, and may be selectively secured by one or more fasteners 270 or other desired devices for aligning and/or securing base 150 to the body 110.

Figure 5:
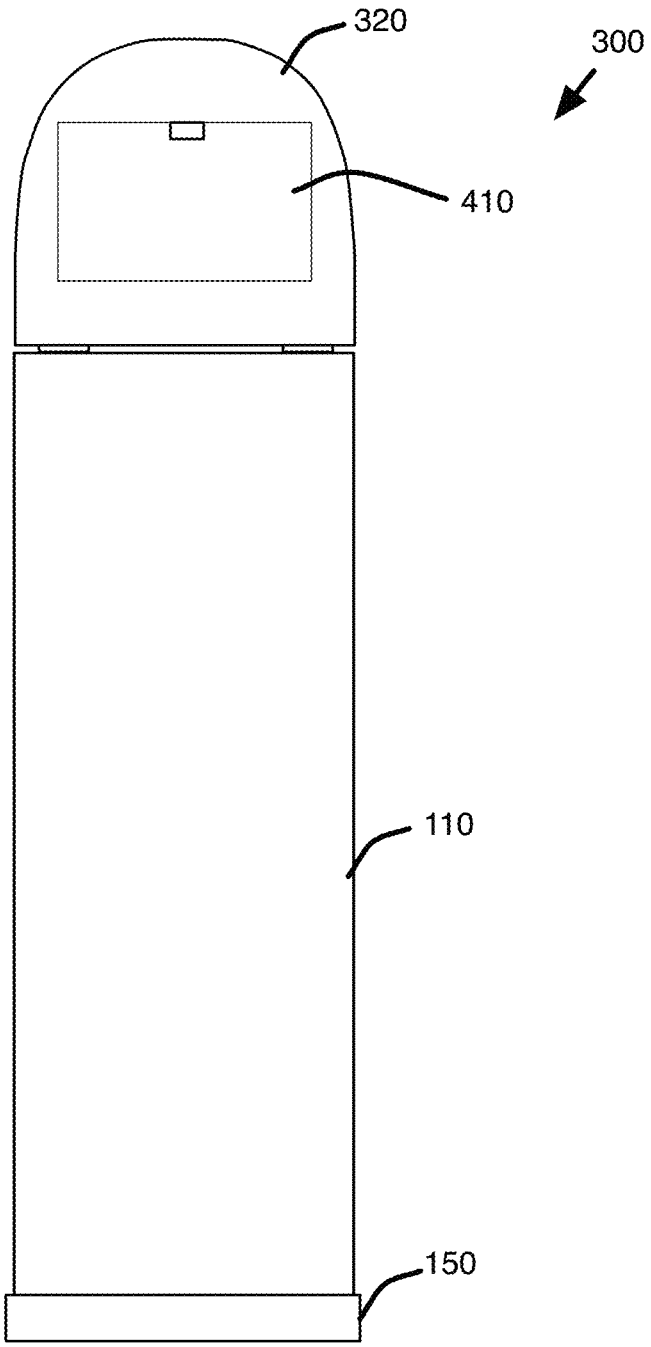
FIG. 5 is a front view schematic illustration of the bathroom accessory storage device of FIG. 3, showing the lid open.

FIG. 5 is a front view of the device 300 of FIG. 3, showing lid 320 in an open position and showing compartment access 410 on a bottom surface of lid 320. In some embodiments, one or more hinges 422 or other devices may be used to secure lid 320 to body 110 (e.g., at or near a top edge of a rear portion of back 114 of the body 110). In some embodiments, lid compartment 410 may include a door 412 or other member for accessing a compartment within the lid 320 for storing wipes or other accessories. In some embodiments, door 412 may be used to refill compartment 410 with wipes that may be pulled or accessed from a slot 322 (see FIG. 3) in the top of the lid 320.

Figures 6A, 6B:
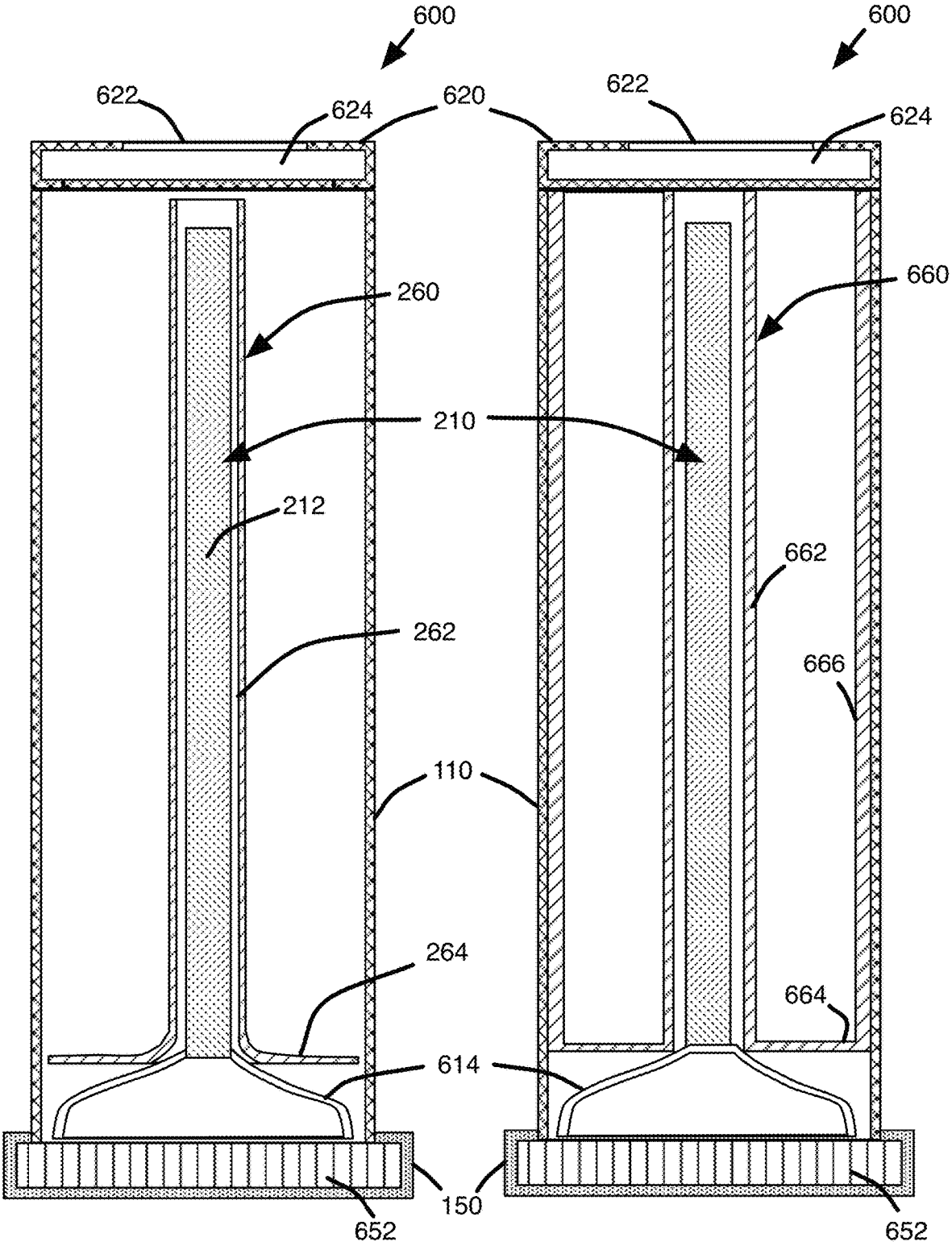
FIG. 6A is a front cross-sectional front view illustration of a bathroom accessory storage device, including a plunger and toilet paper ("TP") holder disposed over the plunger handle.
FIG. 6B is a front cross-sectional front view illustration of the bathroom accessory storage device of FIG. 6A, including a plunger and another example embodiment of a TP holder disposed over the plunger handle.

Turning now to FIG. 6A, a front cross-sectional view of an example apparatus 600 for storing bathroom accessories is shown. In this example, device 600 includes a body 110 with a lid 620 and a base 150. As described above with respect to example devices 100, 300, body 110 of device 600 may be configured and dimensioned to hold a plunger 210 within a central cavity 130 of the body 110. A TP Holder 260 with sleeve 262 and stop, or flange, 264 may be configured to slide over handle 212 of plunger 210 and hold a number of rolls of toilet paper (not shown). In some embodiments, base 150 may include a grate 652, mesh, or other devices to support the head 614 of the plunger while allowing water or other liquid or debris to be captured and retained within base 150, e.g., for later disposal.

In some embodiments, lid 620 may include a wipe compartment 624 or cavity for storing wipes, tissues, or other accessories to be accessed or dispensed from the lid 620, e.g., through slot 622 in the top of the lid.

Figure 10C:
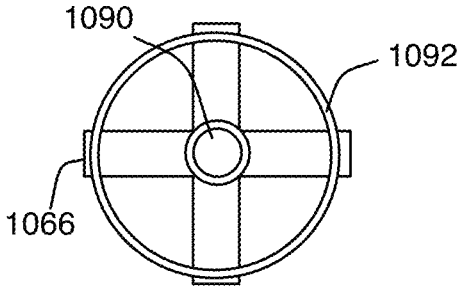
FIGS. 10A, 10B, 10C, and 10D are perspective, side, top, and bottom views, respectively, of an example TP holder for use in a storage device in accordance with an example embodiment.
Figure 10A:
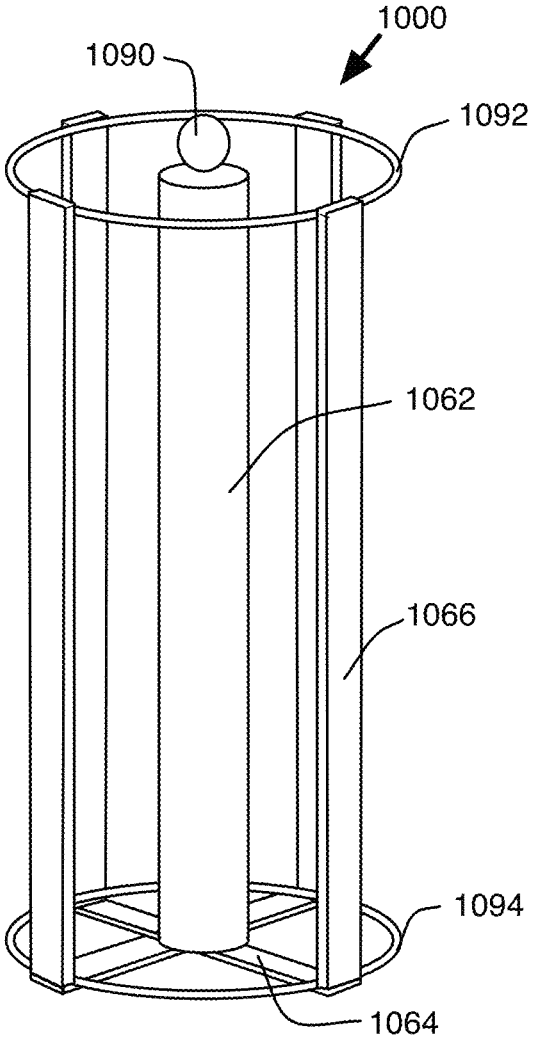
Figure 10B:
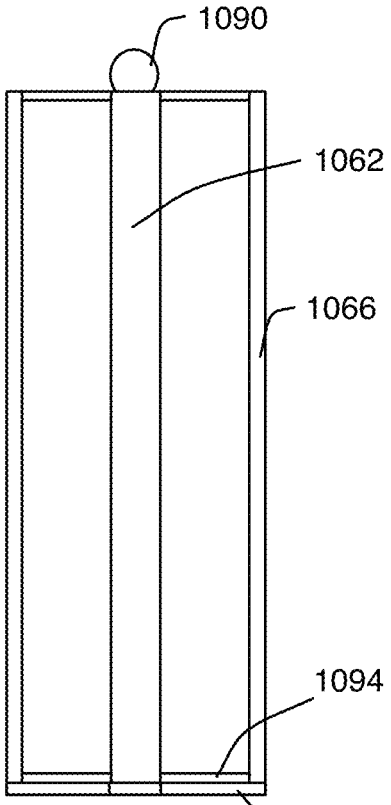

As shown in FIG. 6B, other embodiments of a TP holder 660 may be provided and used within the body 130 of device 600 without departing from the scope of the subject matter herein. For example, holder 660 may include an inner sleeve 662, a flange base 664, and one or more outer supports 666. Sleeve may include an inner channel 668 such that TP holder may be inserted over the handle 212 of a plunger 210 positioned within the TP holder 660. In some embodiments, outer supports 666 may be configured as one or more elongated support members, e.g., as shown in FIG. 10A, e.g., to help retain and position toilet paper rolls disposed over sleeve and within the TP holder. In some embodiments, outer support 666 may be configured as a substantially cylindrical or annular wall dimensioned to fit within body 110 of device 600, and dimensioned to hold one or more rolls of toilet paper (not shown). TP holder stop 664 may serve as a bottom surface for supporting the lower-most roll of toilet paper positioned in the holder.

Other embodiments, arrangements, and features of a TP holder may be employed without departing from the scope of the subject matter hereof, for example as shown and described below with respect to FIGS. 12A to 15B.

In some embodiments, in use, plunger head 614 may rest on a tray 652 of the base 150, e.g., a tray configured to support the head 614 while allowing water and other debris to fall and collect in the bottom of the base. In some embodiments, tray 652 may be configured as, or may include, a grate, vanes, baffles, a perforated plate, or other device for supporting a plunger head 614 away from the bottom of the base where liquid or debris may collect. In some embodiments, body 110 may be removed from base 150, e.g. for emptying or cleaning of the base. In some embodiments, base 150 may be adapted to swivel, e.g., together with body and/or independent of body, to facilitate placement of the device 600 or provide access to rear compartments 710, 712, 714, 716 of FIG. 7.

Figure 7:
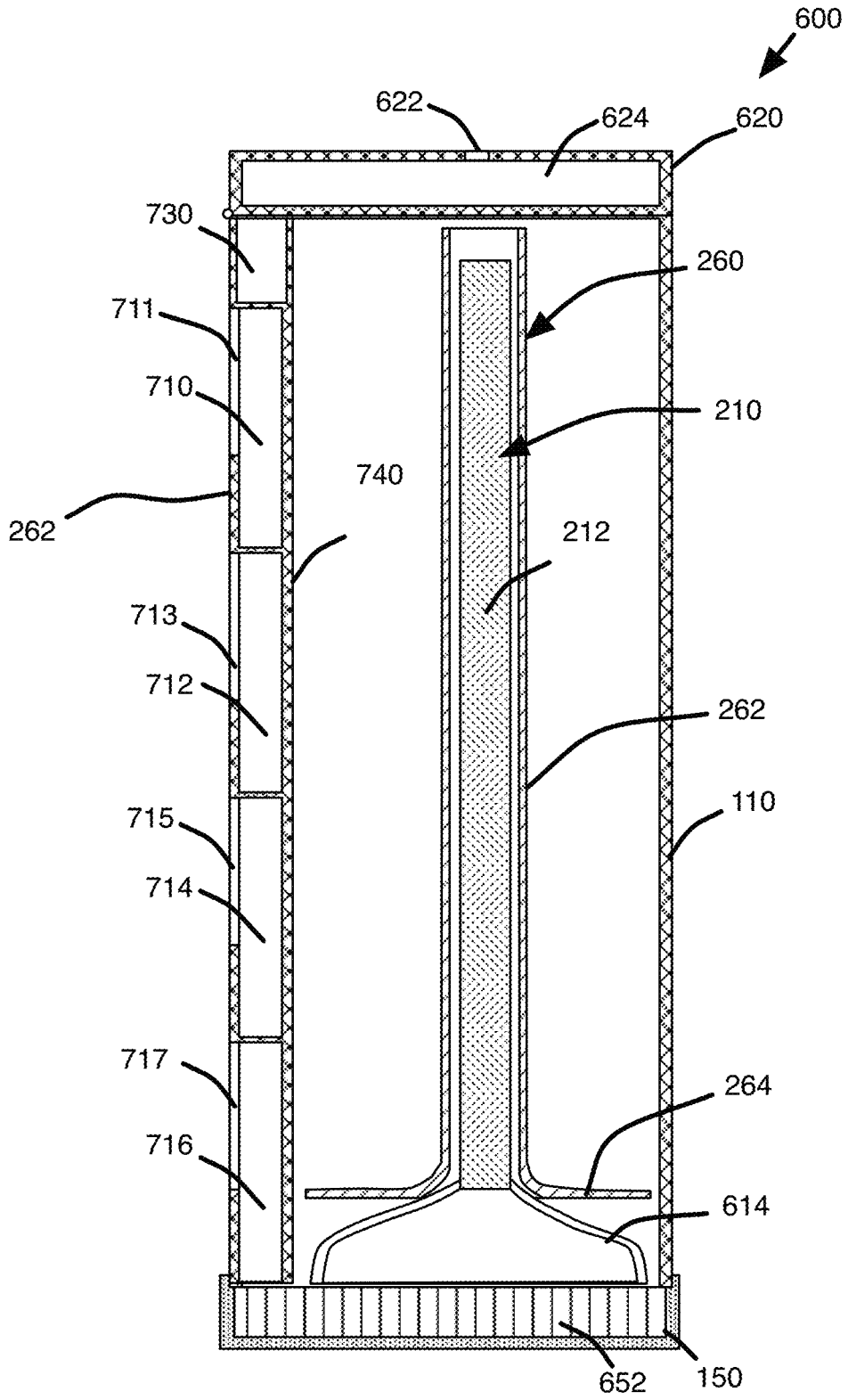
FIG. 7 is a side cross-sectional side view illustration of the bathroom accessory storage device of FIG. 6A.

FIG. 7 shows a side cross-sectional side view of an example embodiment of device 600 of FIG. 6A, including a plunger 210 and TP holder 260 disposed positioned within body 110 and resting on base 150. In this example, a number of compartments 710, 712, 714, 716 may be configured within back wall 114, e.g., between an inner surface 720 and outer surface 722 of the back wall 114 of the body 110. In some embodiments, back wall surfaces 720, 722 may be substantially planar and may be substantially parallel with each other, e.g., such that the back side of the device 600 may be placed against a wall or cabinet (e.g., next to a toilet), and the device may be moved to access openings, doors or panels on the rear of the device. In some embodiments, each compartment may include an access feature such as a slot 711, 713, 715, 717, or a door, opening or other means, for accessing the compartment, e.g., to store and retrieve packages of wipes, tissues, tampons, or other toiletries or accessories. In some embodiments, one or more compartments are configured as a magazine, book, phone, or e-book holder. In some embodiments, access openings to one or more compartments may be positioned on a side of the body 110, e.g., instead of or in addition to the outer surface 722 of the back wall 114.

In some embodiments, a top compartment 730 may be accessible from the top of the device 600, e.g., when lid 620 is opened. In some embodiments, compartment 730 may be configured and dimensioned to hold a bottle or other container of air freshener, or other desired bathroom devices or accessories. As discussed above, lid 620 may include a compartment 624, e.g., for storing and dispensing sanitary wipes. Slot 622 may facilitate dispensing of individual wipes from compartment 624.

Figure 8:
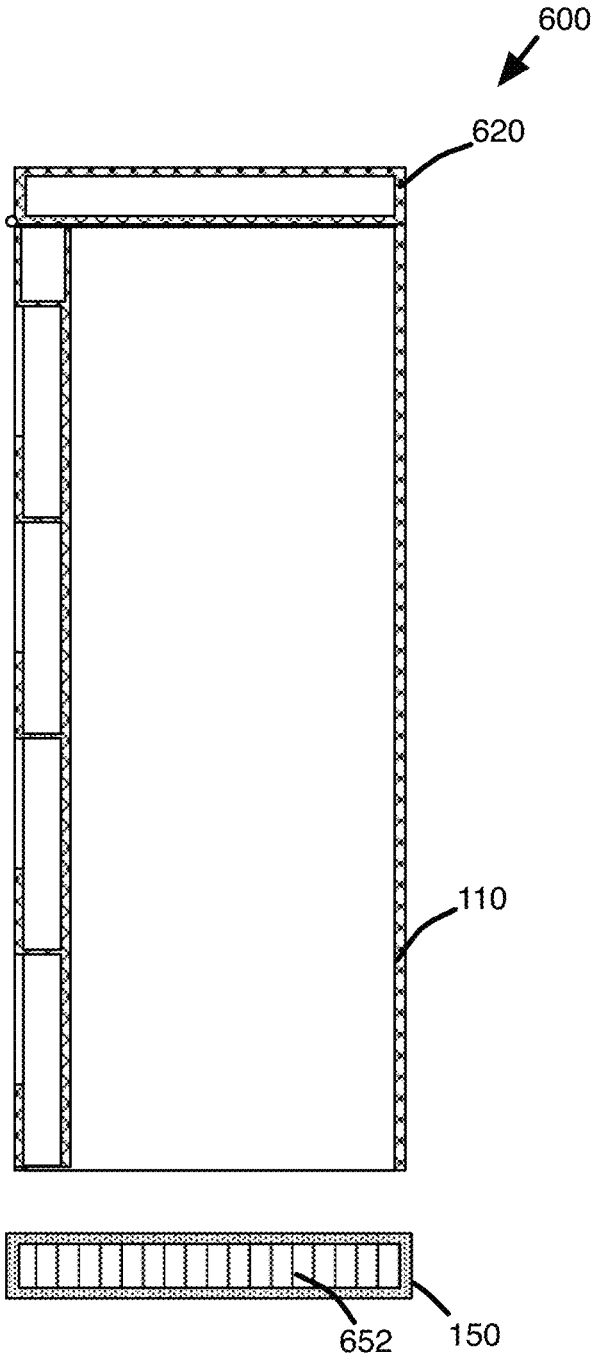
FIG. 8 is a side cross-sectional view illustration of the device of FIG. 7, without the TP holder and plunger of FIG. 7, showing the body detached from the base.

FIG. 8 shows a side cross-sectional view illustration of the device 600 of FIG. 7, without the plunger 210 and TP holder 260 FIG. 7, in this example showing the body 110 detached from its base 150. In some embodiments, base 150 may detachably secured to a bottom end of body 110, e.g., an end opposite from lid 620. In some embodiments, body 110 may be removed from base 150, e.g., so that water or other debris that fell from a plunger into the base (e.g., within the grate or tray 652 area) may be discarded and the base may be cleaned. Tray 652 may be referred to herein as "porous tray" 652, and may incorporate a top grate, vanes, ribs, holes, perforated plate, or other structural features to provide a porous surface for supporting the plunger head above or away from water or other debris collected in the bottom of the base.

Figure 9A:
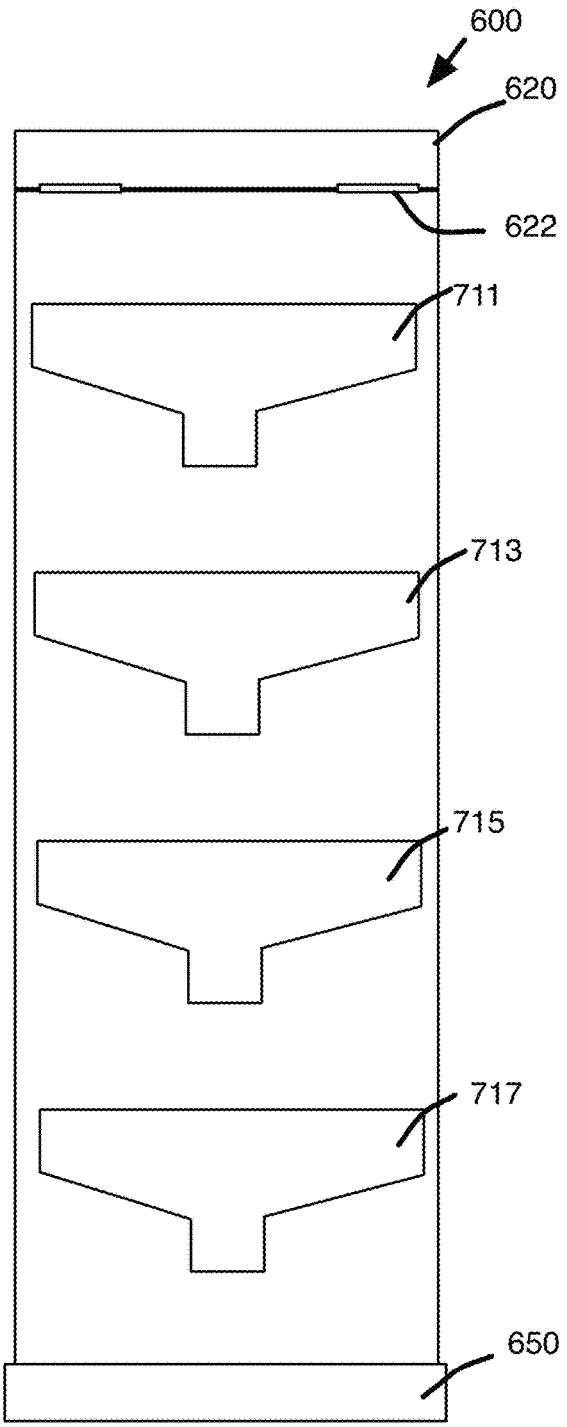
FIG. 9A is a rear view illustration of the device of FIG. 6A, showing access slots to rear storage compartments in accordance with an example embodiment.
Figure 9B:
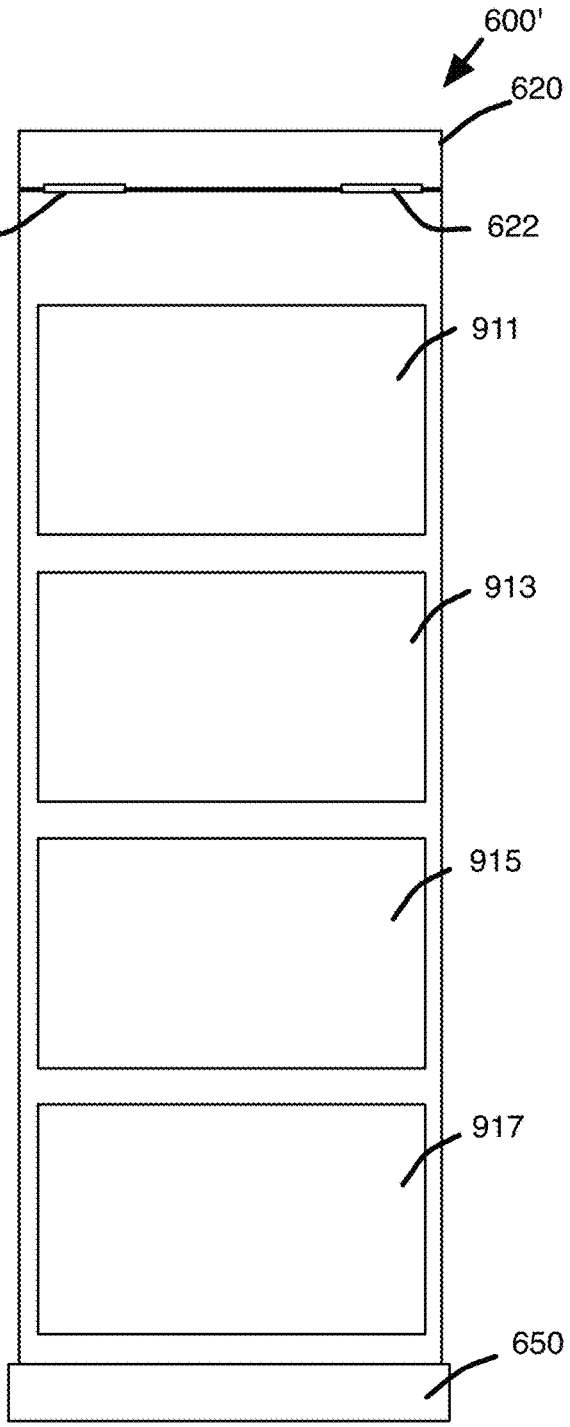
FIG. 9B is a rear view illustration of another embodiment of the device of FIG. 6A, showing access doors to rear storage compartments in accordance with another example embodiment.

Referring to FIG. 9A, and example rear view illustration of device 600 is shown, with access slots 711, 713, 715, 717 as described above. Each slot or other access means may be configured and dimensioned as desired to facilitate storage and removal of desired accessories from corresponding compartments (e.g., compartments 710, 712, 714, 716 of FIG. 7. For example, some embodiments such as device 600' shown in FIG. 9B may have one or more rear access doors 911, 913, 915, 917, e.g., instead of or in addition to slots 711, 713, 715, 717, wherein each access door may be removable or hingably, slidably, or otherwise attached to provide access to the respective compartment. FIGS. 9A and 9B also show a rear view of lid 620, which may be attached to the body by one or more hinges 622 or other members to allow opening of the lid 620 to access the inner cavity and/or a top compartment as discussed above.

Figure 10D:
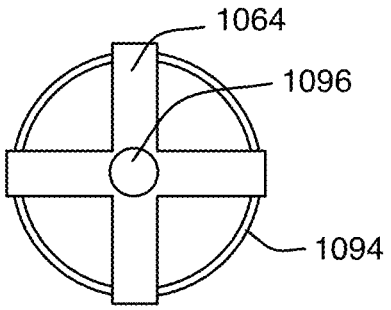

Turning now to FIGS. 10A, 10B, 10C, and 10D, another example embodiment of a TP holder 1000 is shown. In this example, holder 1000 may be similar to TP holder 660 of FIG. 6B, including a substantially cylindrical sleeve 1062, a stop, or flange 1064, and one or more outer supports 1066. An upper end of sleeve 1062 may be capped by a knob 1090 or other device to facilitate gripping the holder 1000, e.g., for removal from a storage device 600. As shown in FIG. 10D, a bottom end of sleeve 1062 may include a hole or other opening 1096 through which the handle of a plunger may fit. In some embodiments, holder 1000 may include one or more rings 1092, 1094, e.g., to help provide structural support to the holder 1000. A stop member 1064 may include one or more flanges, e.g., extending between a wall of the sleeve 1062 and lower ring 1094 and/or one or more support members 1066 (e.g., elongated members oriented substantially perpendicular to stop flanges 1064 and parallel to sleeve 1062), such that stop member 1064 may serve as a support for one or more rolls of toilet paper stacked within holder 1000. In some embodiments, stop member 1064 may be configured as a solid member, e.g., to isolate toilet paper stored in the holder 1000 from the plunger head when holder is placed over the handle of a plunger.

Figures 11A, 11B:
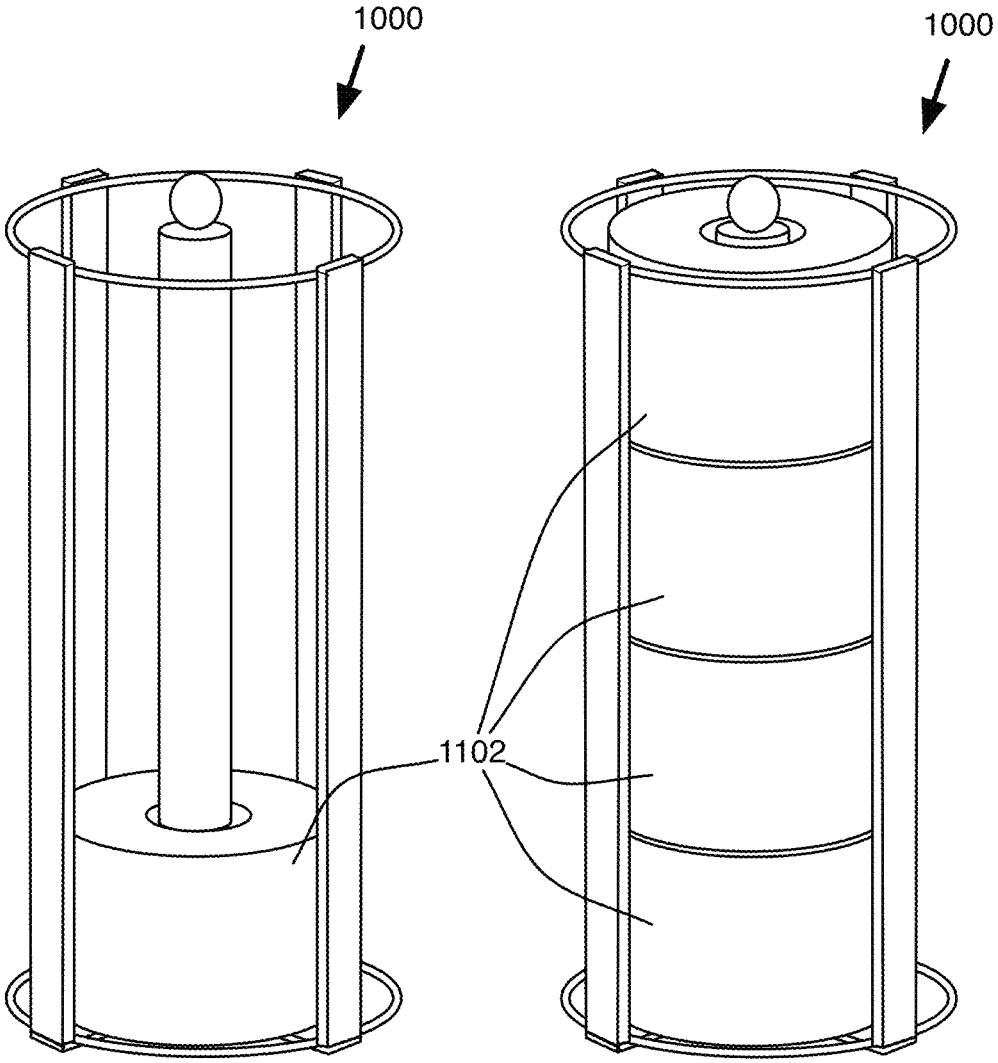
FIGS. 11A and 11B are perspective view illustrations of the example TP holder of FIG. 10A, shown in use with toilet paper rolls disposed over the sleeve of the TP holder.
Figure 15A:
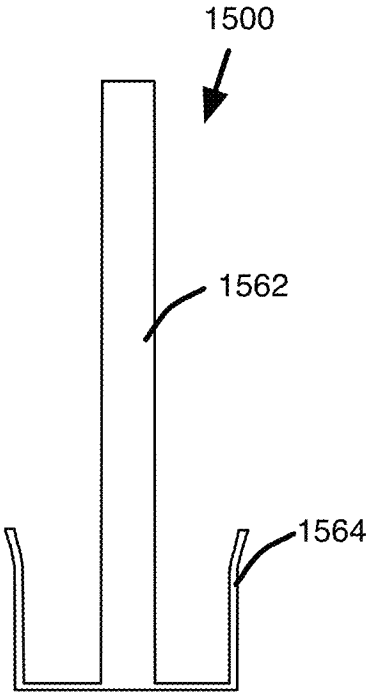
FIGS. 15A and 15B are side and bottom views, respectively, of another example embodiment of a TP holder.
Figure 15B:
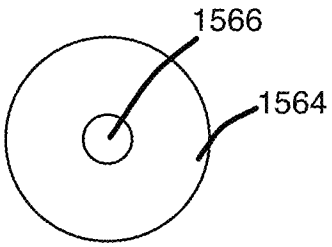
Figure 14A:
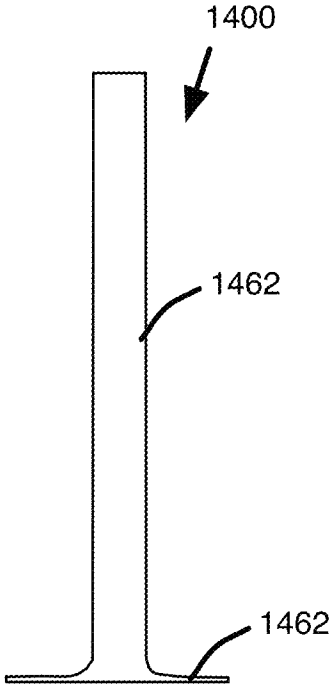
FIGS. 14A and 14B are side and bottom views, respectively, of another example embodiment of a TP holder.
Figure 14B:
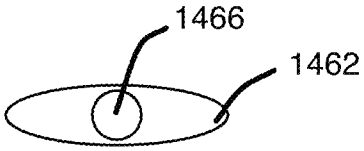
Figure 13A:
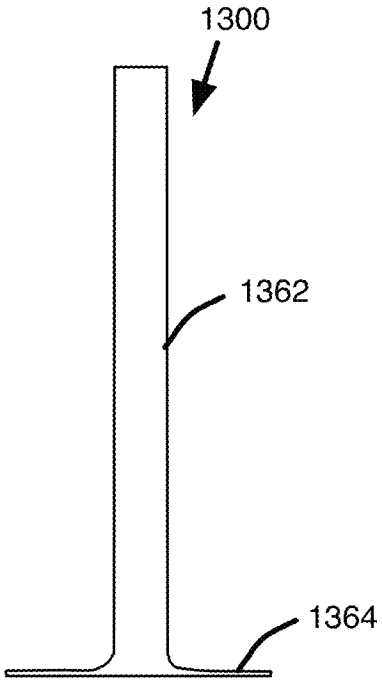
FIGS. 13A and 13B are side and bottom views, respectively, of another example embodiment of a TP holder.
Figure 13B:
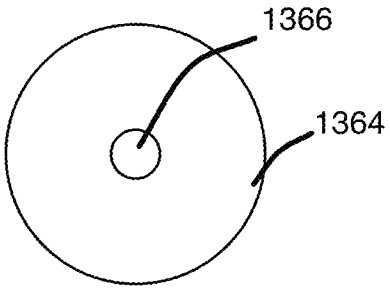
Figure 12A:
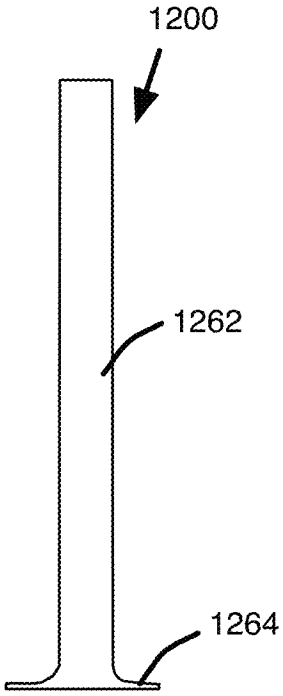
FIGS. 12A and 12B are side and bottom views, respectively, of another example embodiment of a TP holder.
Figure 12B:
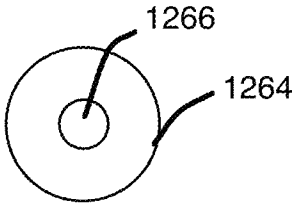

For example, FIGS. 11A and 11B show one and four rolls, respectively, of toilet paper 1102 stacked within example holder 1000, which may be inserted within a storage device, e.g., device 100, 300 or 600. In some embodiments, holder 1000 may be inserted over the handle of a plunger (e.g., plunger 210 of FIG. 2) positioned within a storage device, e.g., device 100, 300, 600. In some embodiments, holder 1000 may inserted into and/or store within a storage device without a plunger.

FIGS. 12A through 15B show other example embodiments of toilet paper holders for use with a storage device as described herein. Each example holder 1200, 1300, 1400, 1500 may include a sleeve, e.g., sleeves 1262, 1362, 1462, 1562, respectively, each configured to fit over the handle of a plunger. Each holder 1200, 1300, 1400, 1500 may also include a lower flange or stop member 1264, 1364, 1464, 1564 for supporting toilet paper within a bathroom storage device (e.g., device 100, 300, 600), and base/flange may be differently configured and dimensioned as desired, as shown in FIGS. 11B, 12B, 13B, and 14B. In each example embodiment, openings 1264, 1364, 1464, 1564 in the bottom of each corresponding sleeve may be configured and dimensioned to fit over a plunger handle or other device as desired.

Figure 16A:
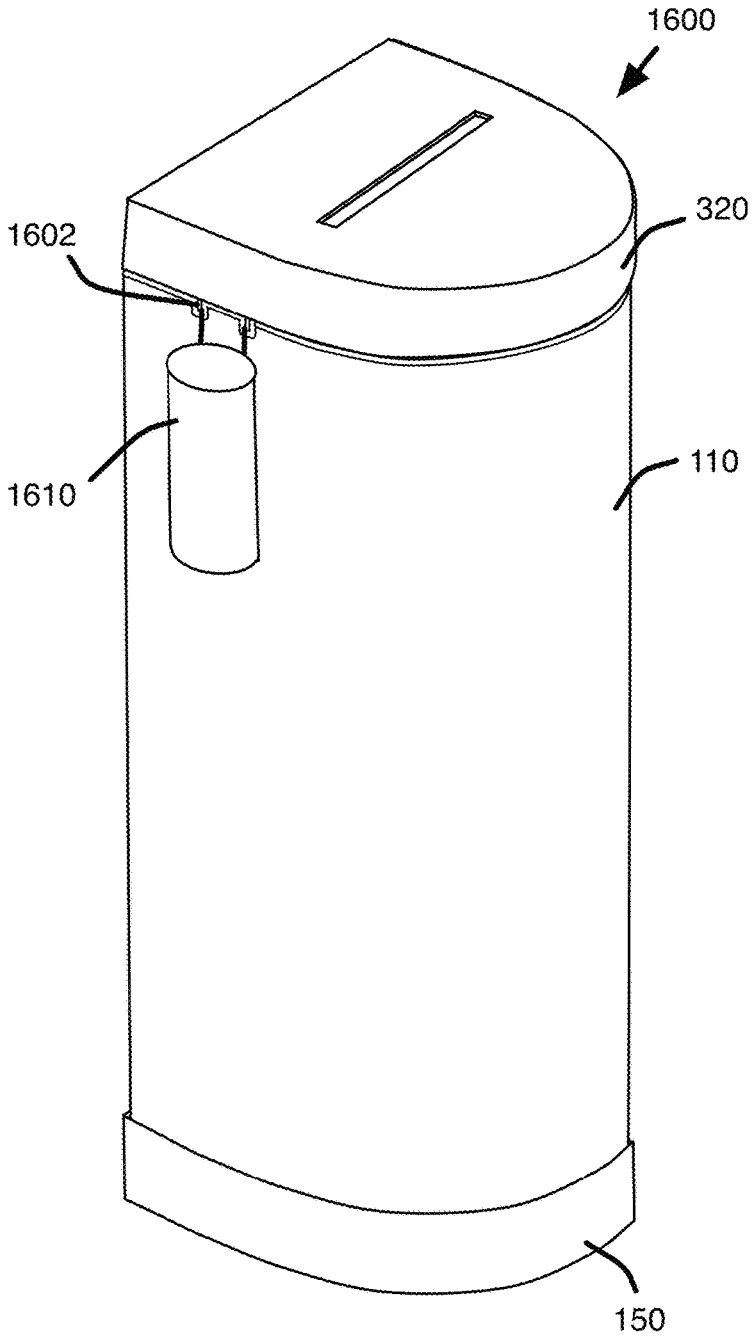
FIG. 16A is a perspective view illustration of an example embodiment of a bathroom accessory storage device, including slots for attaching an air freshener caddy or other accessory.
Figure 16B:
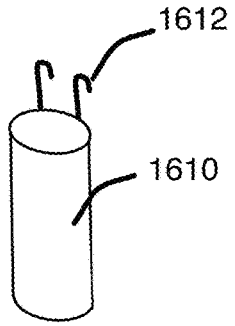
FIG. 16B is a perspective view illustration of an air freshener caddy in accordance with an example embodiment.
Figure 16C:
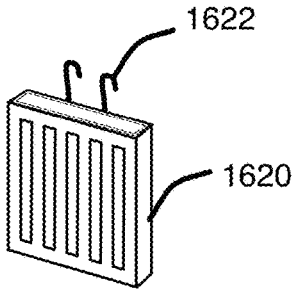
FIG. 16C is a perspective view illustration of a diffusion air freshener accessory in accordance with another example embodiment.
Figure 16D:
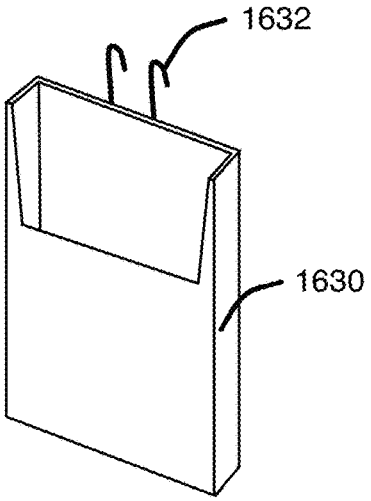
FIG. 16D is a perspective view illustration of a caddy accessory in accordance with another example embodiment.

FIG. 16A is a perspective view illustration of another example embodiment of a bathroom accessory storage device 1600, including a body 110, base, 150, and lid 320 having a slot 322 or other opening or access feature for accessing wipes stored within a compartment in the lid 320. In this example, device 1600 may include one or more slots 1602 or other features for hanging or otherwise securing an external accessory, referred to herein as a "caddy" to the body 110 or lid 320, e.g., including slots for attaching an air freshener caddy 1610 or other accessory. For example, an air freshener caddy 1610 may be configured and dimensioned to hold a pump spray or aerosol container of air freshener for easy access. As shown in FIG. 16B, an example caddy 1610 or other accessory may include one or more hooks 1612 or other attachment members configured to engage with slots 1602 or otherwise secure to device 1600. As shown in FIG. 16C, other types or arrangements of air freshener devices or holders 1620 may be used and adapted with hooks 1622 or other members to secure to storage device 1600. Various other accessories or devices may be adapted to hang on or otherwise secure to body 110 or lid 320 of a device 1600, for example a universal caddy 1630 as shown in FIG. 16D may be adapted to hold any desired items, such as an air freshener container, cell phone, e-book, book, music player, speaker, magazine, tissues, tampons, cigarettes, matches, or any other desired accessories or items. In some embodiments, various other types or configurations of accessories or holders may be adapted to attach to a storage device.

Figure 17B:
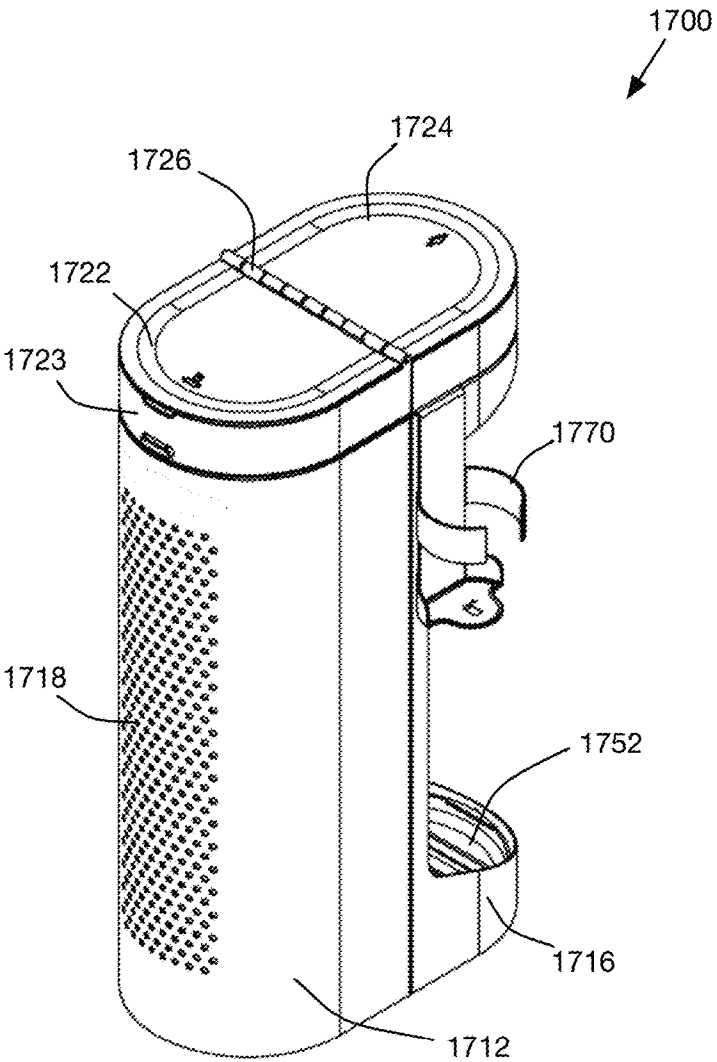
FIG. 17B is a front perspective view illustration of the bathroom accessory storage device of FIG. 17A.
Figure 17A:
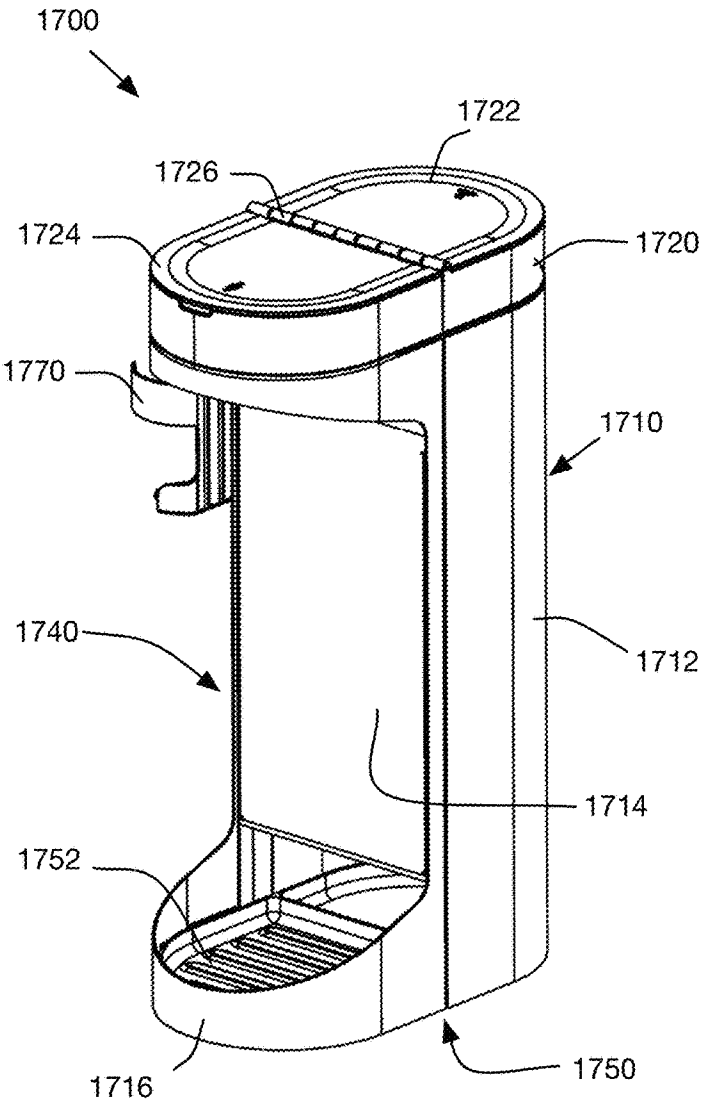
FIG. 17A is a rear perspective view illustration of a bathroom accessory storage device in accordance with another example embodiment.
Figure 18:
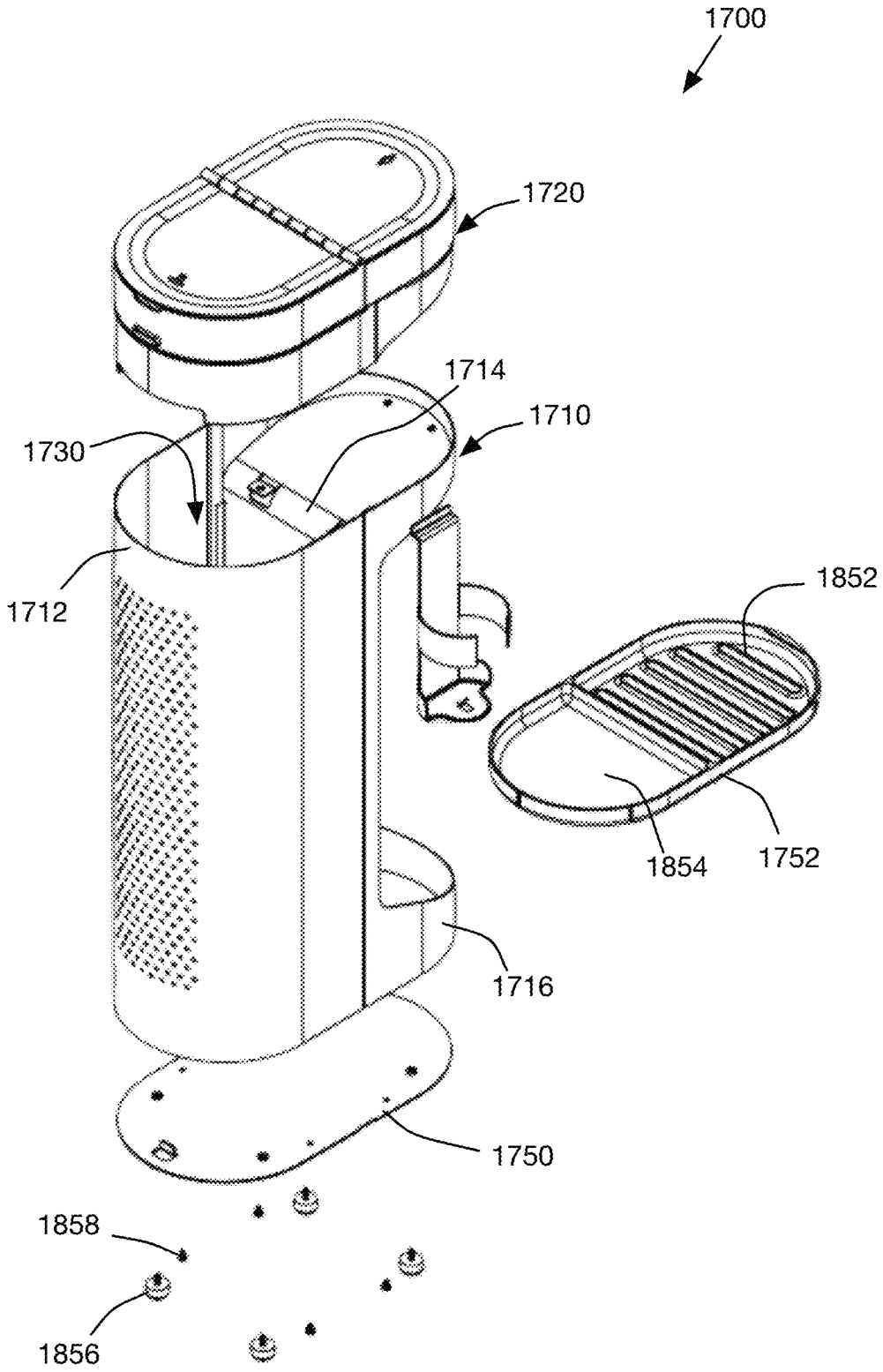
FIG. 18 is an exploded perspective view illustration of the bathroom accessory storage device of FIG. 17B.

Turning now to FIGS. 17A through 28E, another example embodiment of a device 1700 or apparatus for storing bathroom accessories is shown. As shown in FIGS. 17A, 17B, and 18, for example, storage device 1700 may include a body 1710 disposed between an upper housing 1720 (also referred to herein as upper compartment assembly 1720) and a base 1750. Body 1710 may include a front wall 1712, a divider 1714 (which may form a rear wall as described in more detail below), and a frame 1716. In some embodiments, front wall 1712 and divider 1714 may define a central cavity 1730, or elongated central storage compartment, e.g., configured and dimensioned for storing multiple rolls of toilet paper. In some embodiments, body 1712 may include an array of holes 1718 or other features to provide flow of air into and out of central compartment 1730.

In some embodiments, frame 1716 and divider 1714 may partially define an area 1740 for storage of a plunger and/or brush, or other desired tools or accessories. In some embodiments, a tray 1752 may fit within frame, e.g., supported by base 1750, for holding the head of a plunger. In some embodiments, tray 1752 may include ribs 1852, dimples, vanes, or other features to facilitate drying of a plunger head (e.g., as shown in FIG. 18). Tray 1752, may also include one or more areas 1854 for storage of an air freshener or other item(s). In some embodiments, base 1750 may secure to body 1710 using fasteners 1858 and may also include one or more feet 1856 to provide stability to the device 1700.

In some embodiments, upper compartment assembly 1720 may include a front compartment lid 1722 and/or a rear compartment lid 1724, each of which may be hingably secured to each other and/or the housing 1720 by a hinge 1726 or other feature. In some embodiments, front lid 1722 may be configured and dimensioned to open about hinge 1726 to access a front storage compartment (e.g., compartment 2102 of FIG. 21C and FIG. 28C), and/or body 1723 of front compartment may be hingably opened (together with front lid 1722) to access central storage cavity 1730. In some embodiments, rear lid 1724 may be configured and dimensioned to open about hinge 1726 to access a rear storage compartment (e.g., compartment 2104 of FIG. 21C and FIG. 28D). In some embodiments, an accessory caddy 1770 may attach to a side of the device 1700, e.g., to a portion of upper housing 1720 and/or body 1710, and may include features for holding an air freshener dispenser or other desired items as described above with respect to example storage device 100.

Figure 19B:
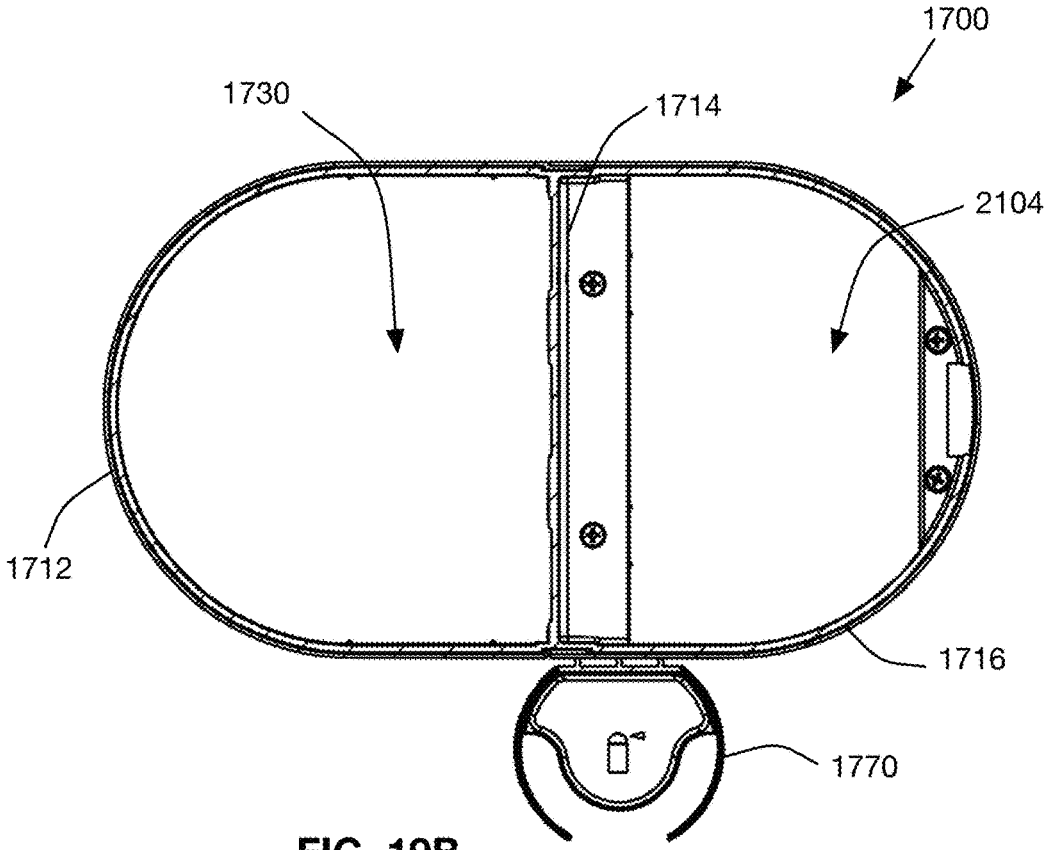
FIG. 19B is a top cross-sectional view illustration of the bathroom accessory storage device of FIG. 19A.
Figure 19A:
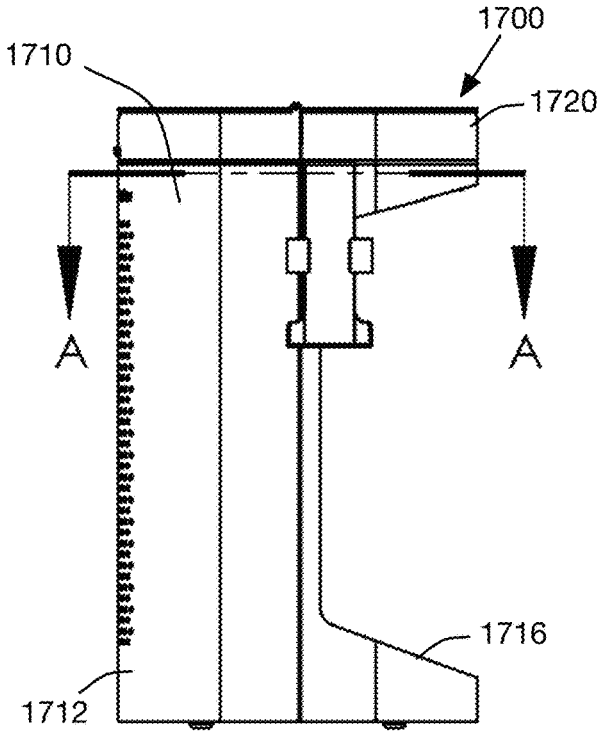
FIG. 19A is a side view illustration of the bathroom accessory storage device in accordance with an example embodiment.

FIG. 19B shows a cross-sectional top view of example storage apparatus 1700, taken through line A-A of body 1710 and upper compartment assembly 1720 of FIG. 19A. As shown, central cavity 1730 (e.g., for storing toilet paper or other desired items), may be defined by front wall 1712 and a rear wall portion 2010 (of FIG. 20B) of divider 1714. Similarly, frame 1716 and an upper portion 2012 (see FIG. 20B) of divider 1714 may define the outer edges and bottom, respectively, of rear storage compartment 2104 (see FIG. 21C) of compartment assembly 1720.

Figure 20C:
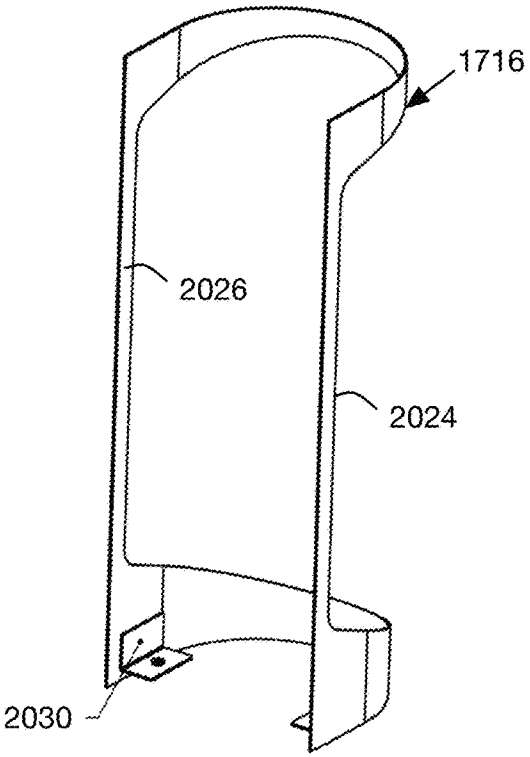
FIG. 20C is a perspective view illustration of a body frame of a bathroom accessory storage device in accordance with an example embodiment.
Figure 20B:
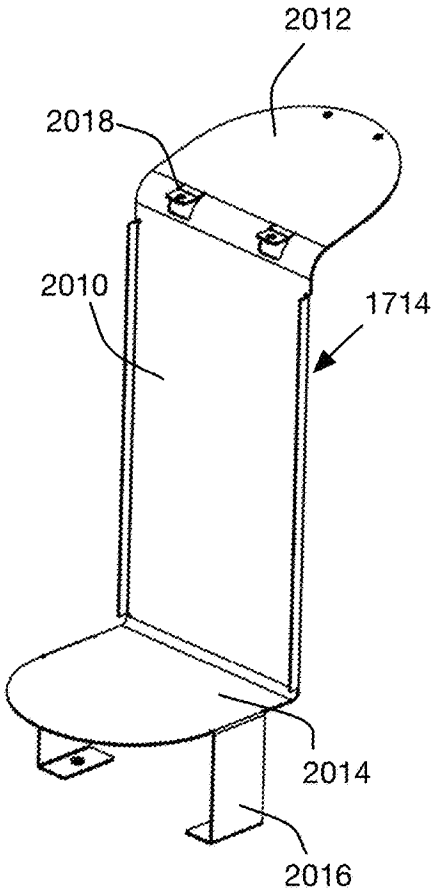
FIG. 20B is a perspective view illustration of a body divider of a bathroom accessory storage device in accordance with an example embodiment.
Figure 20A:
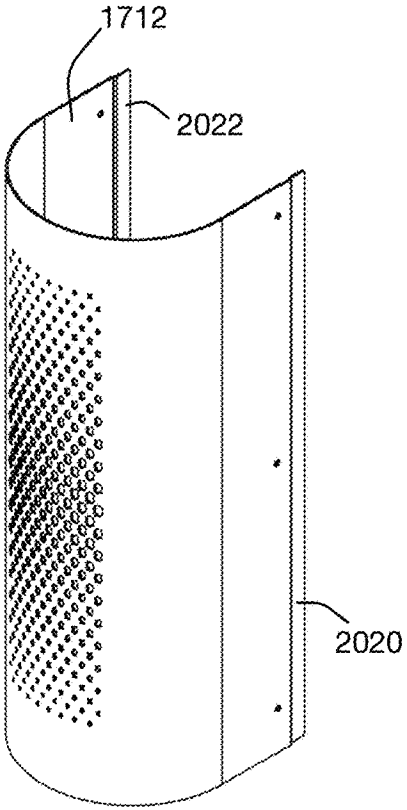
FIG. 20A is a perspective view illustration of the body wall of a bathroom accessory storage device in accordance with an example embodiment.

As further shown in FIGS. 20A, 20B and 20C, front wall 1712, divider 1714, and frame 1716, respectively, are configured and dimensioned to fit and secure together to form the various storage compartments, cavities, and other features as described herein for storing bathroom accessories. In some embodiments, wall 1712 may include one or more flanges 2020, 2022, e.g., for receiving and/or mating with edges 2024, 2026 of frame. In some embodiments, divider 1714 may include a substantially vertical rear wall portion 2010, a substantially horizontal base portion 2014 (e.g., for forming the bottom of cavity 1730 and supporting one or more rolls of toilet paper), and an upper portion 2012 (for forming the bottom of rear storage compartment 2104 as described above). Divider 1714 may also include one or more feet or bracket members 1016, e.g., for supporting base portion 2014 at a desired height and securing to frame 1716, e.g., at one or more corresponding brackets 2030.

Figure 21C:
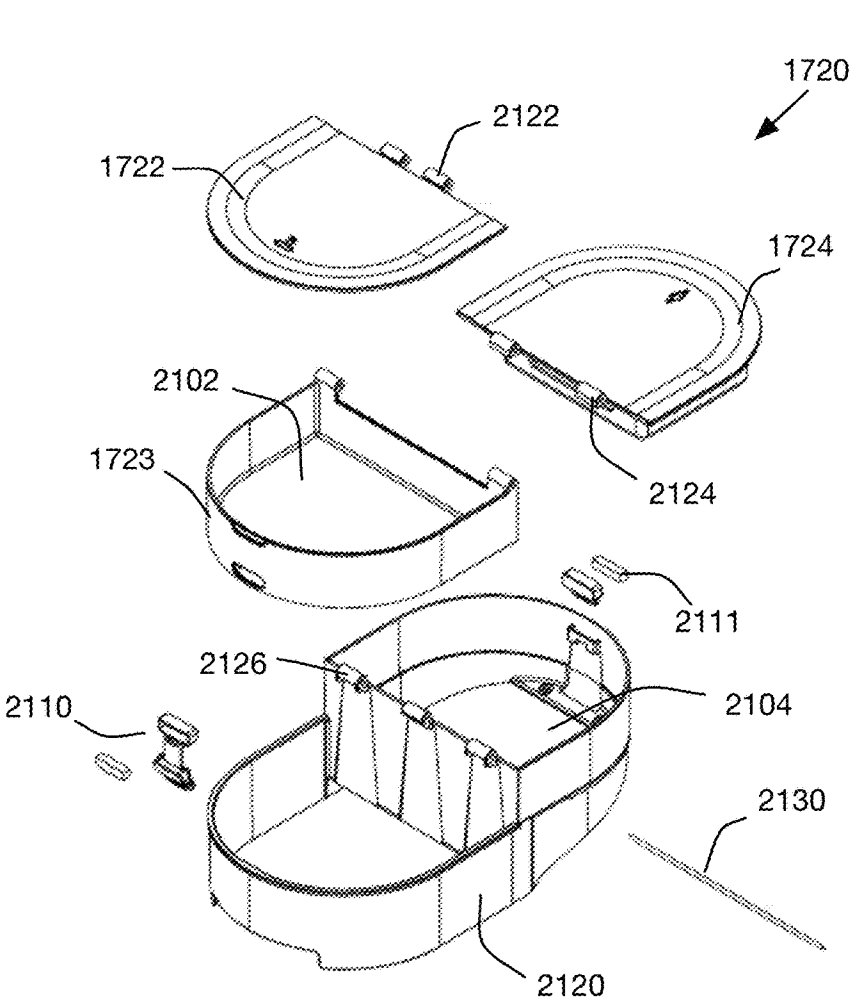
FIG. 21C is an exploded perspective view illustration of the upper housing assembly of FIG. 23A.
Figure 21A:
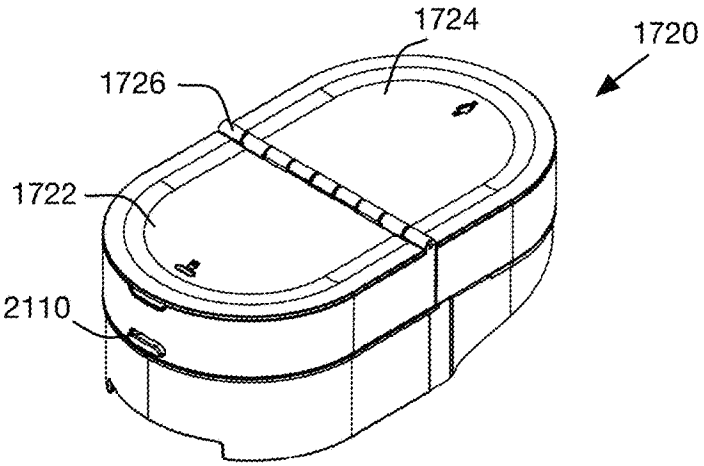
FIG. 21A is a top perspective view illustration of an upper housing assembly of a bathroom accessory storage device in accordance with an example embodiment.
Figure 21B:
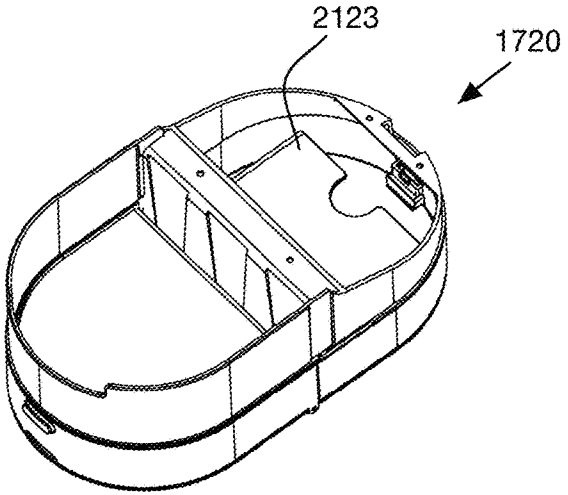
FIG. 21B is a bottom perspective view illustration of the upper housing assembly of FIG. 23A.
Figure 22E:
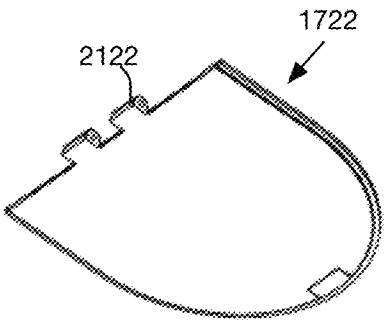
FIG. 22E is a bottom perspective view illustration of the example front lid of FIG. 22A.
Figure 22D:
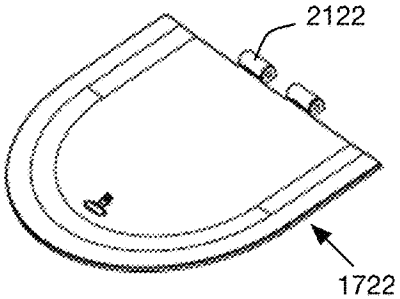
FIG. 22D is a top perspective view illustration of the example front lid of FIG. 22A.
Figure 22A:
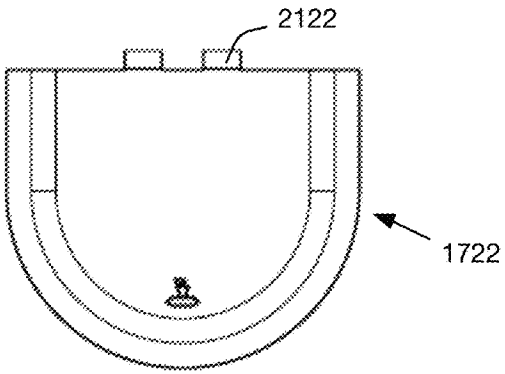
FIG. 22A is a top view of illustration of an example front lid of the upper housing assembly of FIG. 21A.
Figure 22B:
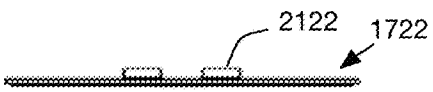
FIG. 22B is an end view illustration of the example front lid of FIG. 22A.
Figure 22C:
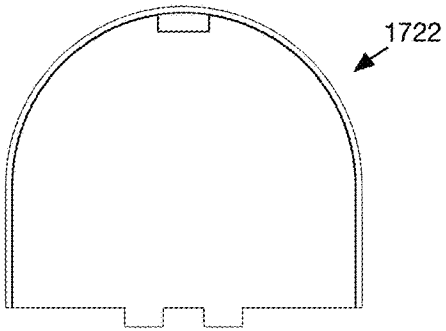
FIG. 22C is a bottom view illustration of the example front lid of FIG. 22A.
Figure 23A:
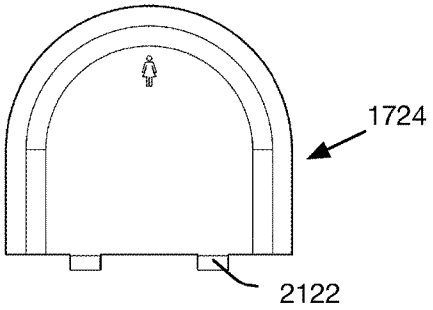
FIG. 23A is a top view of illustration of an example back lid of the upper housing assembly of FIG. 21A.
Figure 23B:
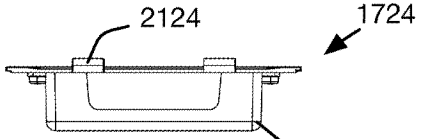
FIG. 23B is an end view illustration of the example rear lid of FIG. 23A.
Figure 23C:
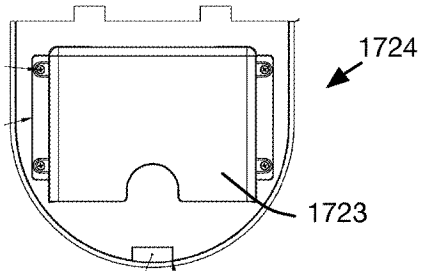
FIG. 23C is a bottom view illustration of the example rear lid of FIG. 23A.
Figure 23D:
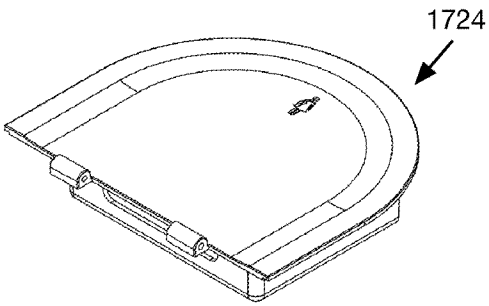
FIG. 23D is a top perspective view illustration of the example rear lid of FIG. 23A.
Figure 23E:
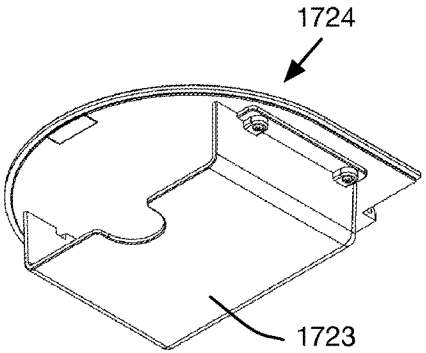
FIG. 23E is a bottom perspective view illustration of the example rear lid of FIG. 23A.

FIGS. 21A, 21B and 21C show details of upper housing 1720 or upper compartment assembly, some of which are described above. Also shown are a front button assembly 2110, clips, magnets, or other closure features for opening the front compartment body 1723 and/or lid 1722, as well as one or more closure features 2111 for engaging lid 1724. As shown, hinge 1726 may comprise one or more hinge members 2122, 2124, 2126 of front lid 1722, rear lid 1724, and housing 1720, respectively, which hinge members may be joined by a hinge pin 2130. In some embodiments, lid 1724 may include a holder 2123 disposed on a bottom surface of the lid, e.g., for holding sanitary napkins or other desired items (e.g., as shown in FIGS. 23E and 28D).

FIG. 22A through FIG. 22E show various views of front lid 1722, having hinge members 2122 and other features in accordance with an example embodiment. Similarly, FIG. 23A through FIG. 23E show various views of rear lid 1724, having hinge features 2124, holder 1723, and other features in accordance with example embodiments.

Figure 24C:
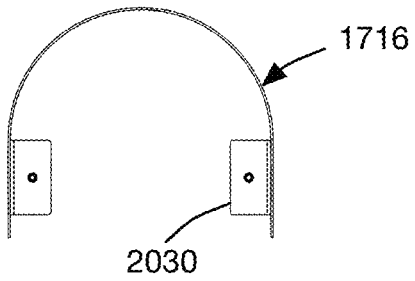
FIG. 24C is a top view illustration of the example body frame of FIG. 21A.
Figure 24A:
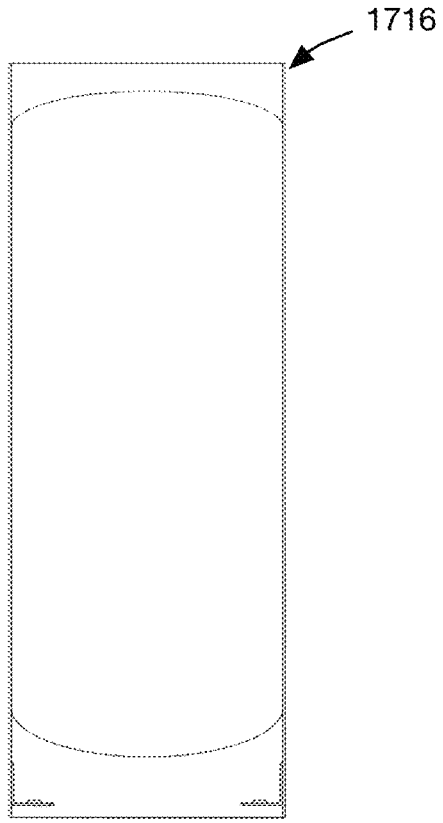
FIG. 24A is a front view illustration of the example body frame of FIG. 20C in accordance with an example embodiment.
Figure 24B:
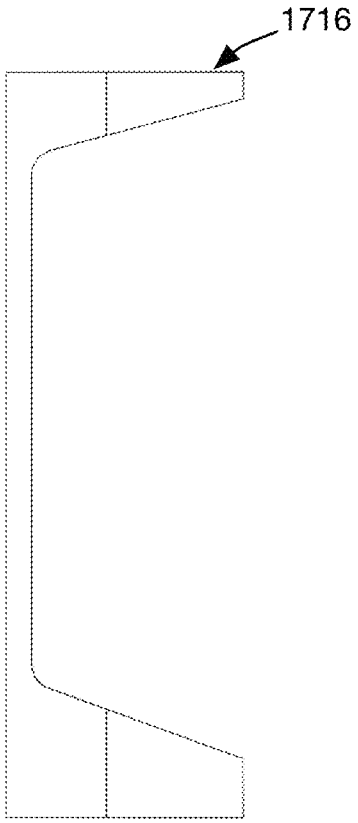
FIG. 24B is a side view illustration of the example body frame of FIG. 21A.
Figure 25C:
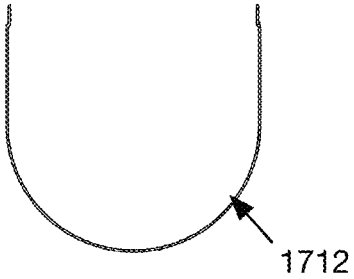
FIG. 25C is a top view illustration of the example body wall of FIG. 21A.
Figure 25A:
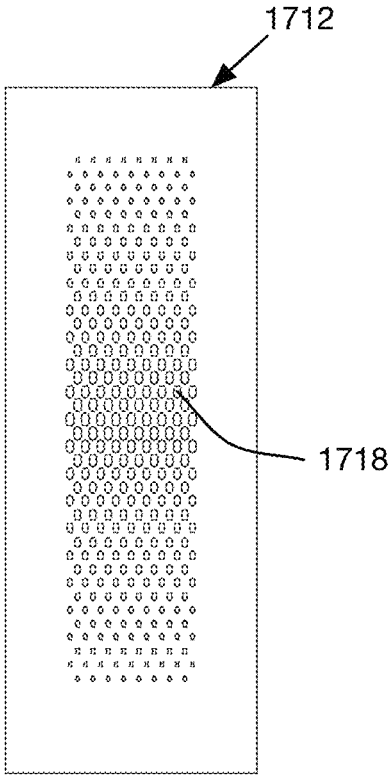
FIG. 25A is a front view illustration of the example body wall of FIG. 20A in accordance with an example embodiment.
Figure 25B:
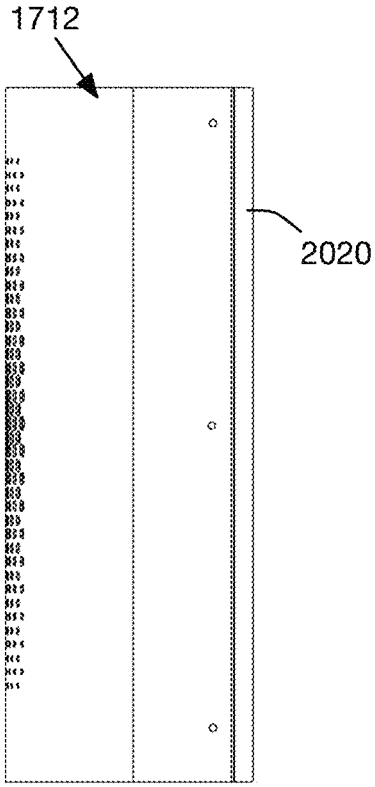
FIG. 25B is a side view illustration of the example body wall of FIG. 21A.
Figure 26:
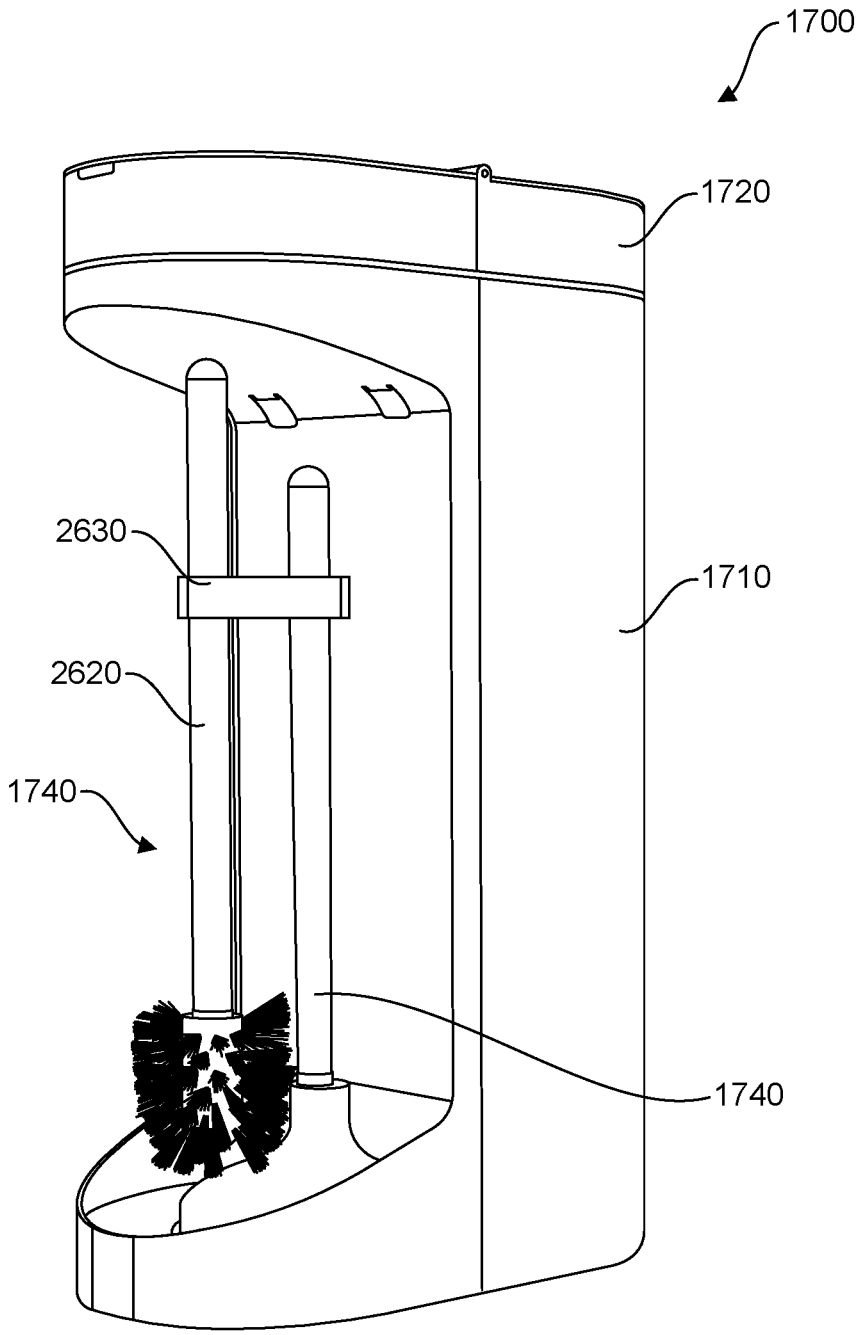
FIG. 26 is another perspective view illustration of a bathroom accessory storage device in accordance with an example embodiment, including a stored plunger and brush.

FIG. 24A through FIG. 24C show front, side, and top views, respectively of a frame 1716 having features as described herein in accordance with example embodiments. Similarly, FIG. 25A through FIG. 25C show front, side, and top views, respectively, of a body wall 1712 having features as described herein in accordance with example embodiments.

FIG. 26 through FIG. 28E show various perspective views of an example storage device 1700 in use. For example, area 1740 of device 1700 may be configured and dimensioned as described herein to support a plunger 2610 and/or a toilet brush 2620. In some embodiments, a clip 2630 or other device may be used to secure brush 2620 to a handle of plunger 2610 as shown, for example to keep a head of the brush in a desired position, e.g., suspended above the head of the plunger.

Figure 27:
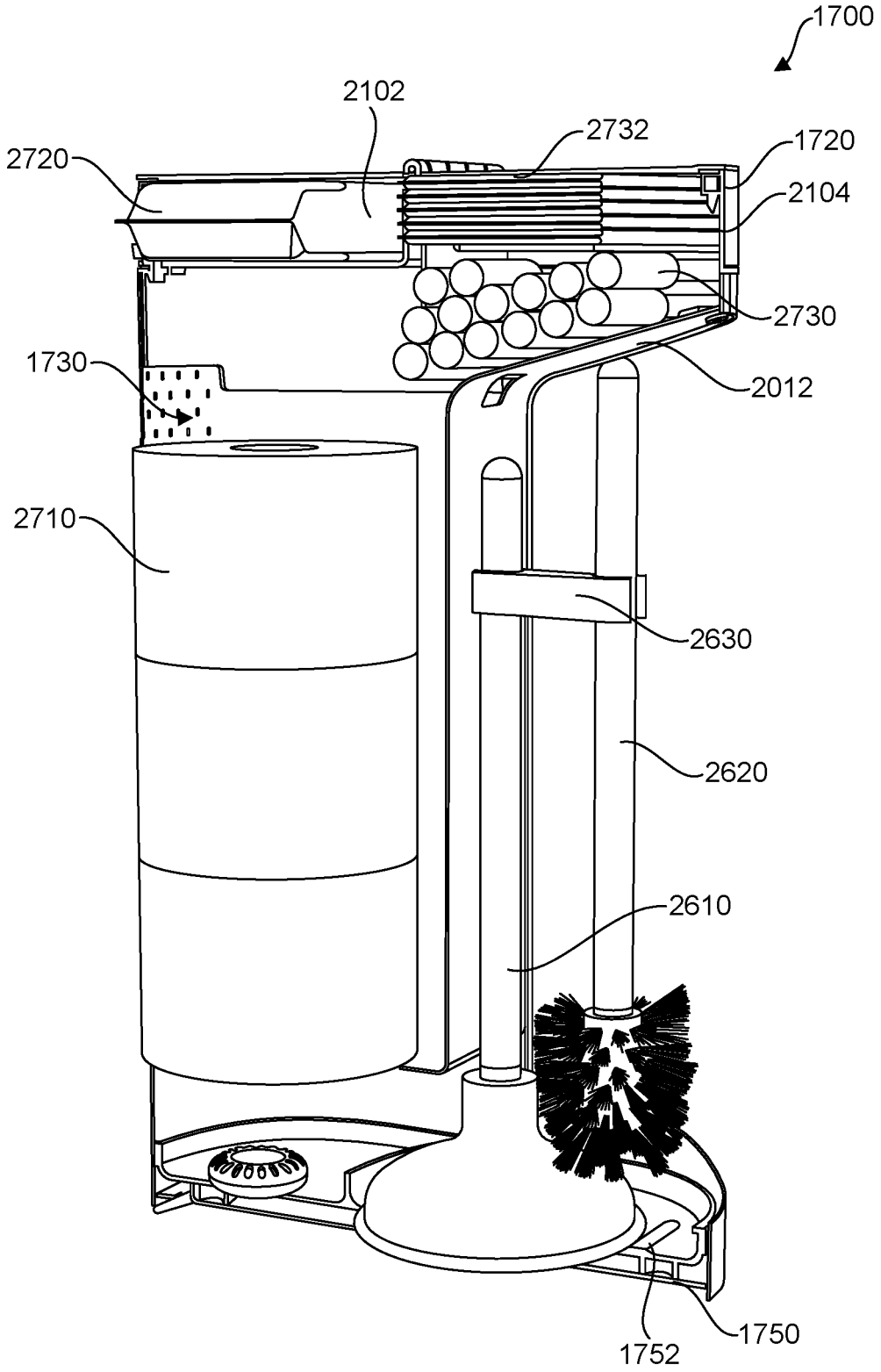
FIG. 27 is a cross-sectional perspective view illustration of the storage device of FIG. 26, in use with stored accessories in accordance with an example embodiment.

FIG. 27 shows a schematic cross-sectional illustration of a storage apparatus 1700 in use for storing different accessories, including rolls of toilet paper 2710 within central compartment 1730, wipes 2720 within front upper compartment 2102, and sanitary napkins 2732 and tampons 2730 within rear compartment 2104. In this example, base 1750 supports tray 1752, upon which the base of a plunger 2610 may rest. In some embodiments, upper portion 2012 of the divider may include one or more hooks (not shown) or other features or devices for hanging a plunder, brush, and/or other accessories.

Figure 28A:
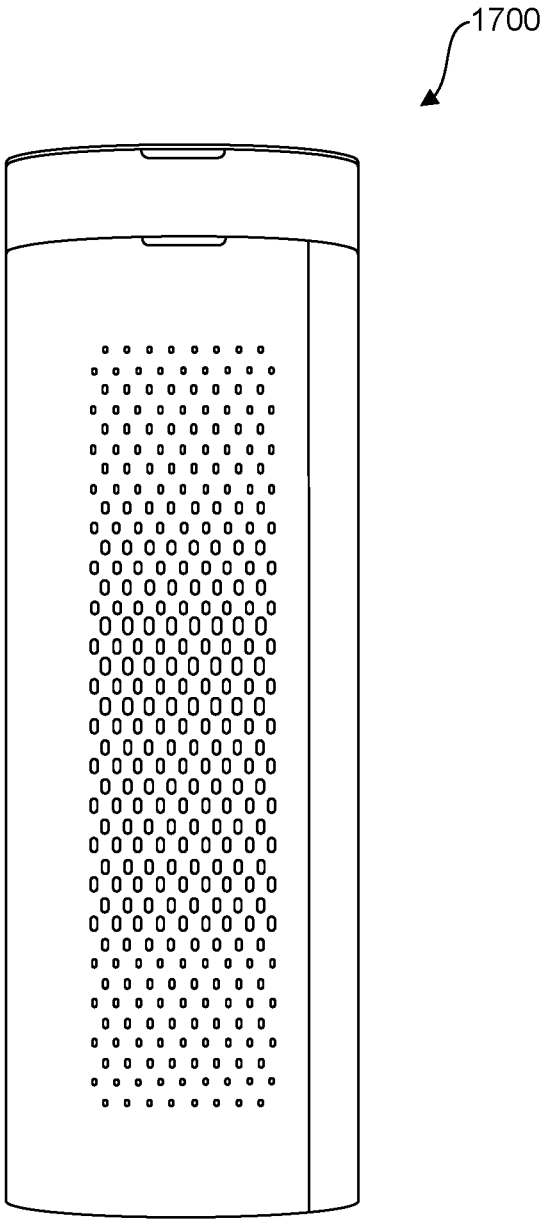
FIG. 28A is a front view illustration of the example device of FIG. 26.
Figure 28B:
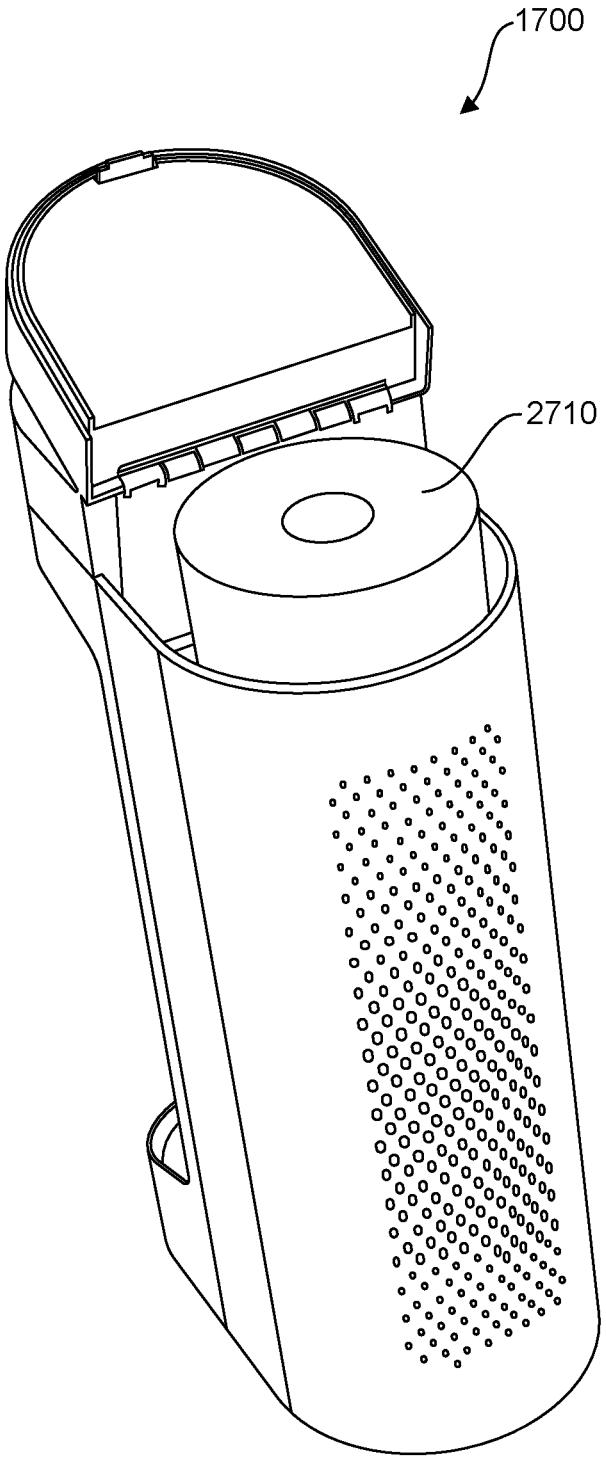
FIG. 28B is a top perspective view illustration of the example device of FIG. 26, in use with the front portion of upper housing open.
Figure 28C:
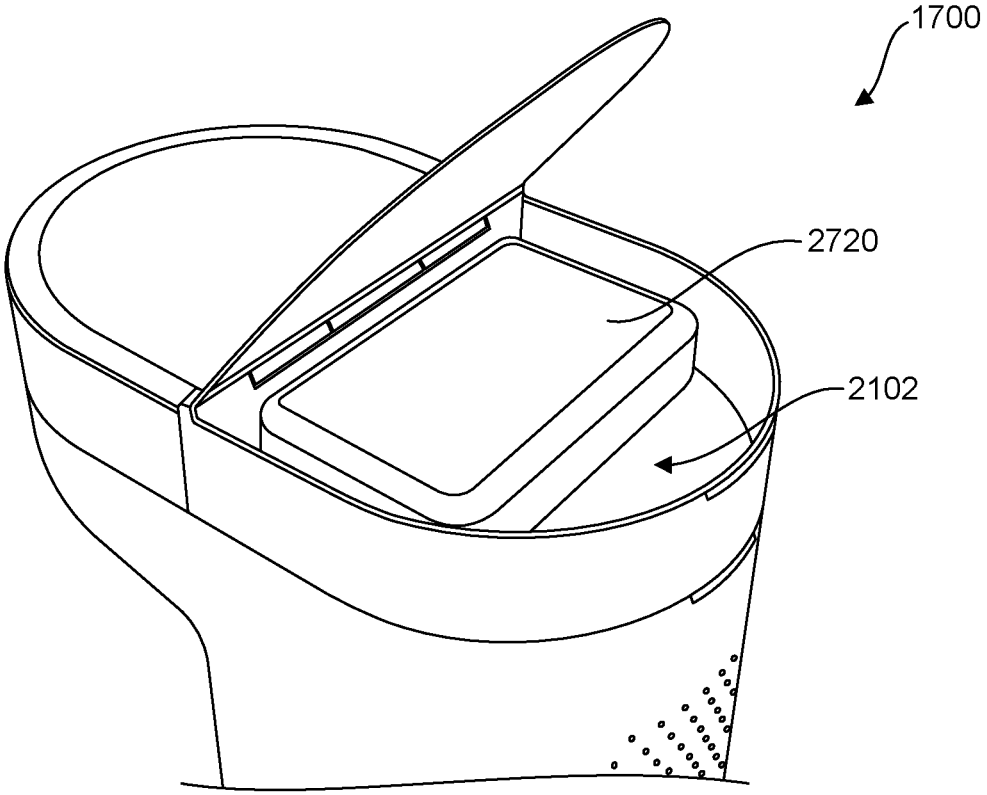
FIG. 28C is a close up top perspective view illustration of the example device of FIG. 26, in use with the front lid open.
Figure 28D:
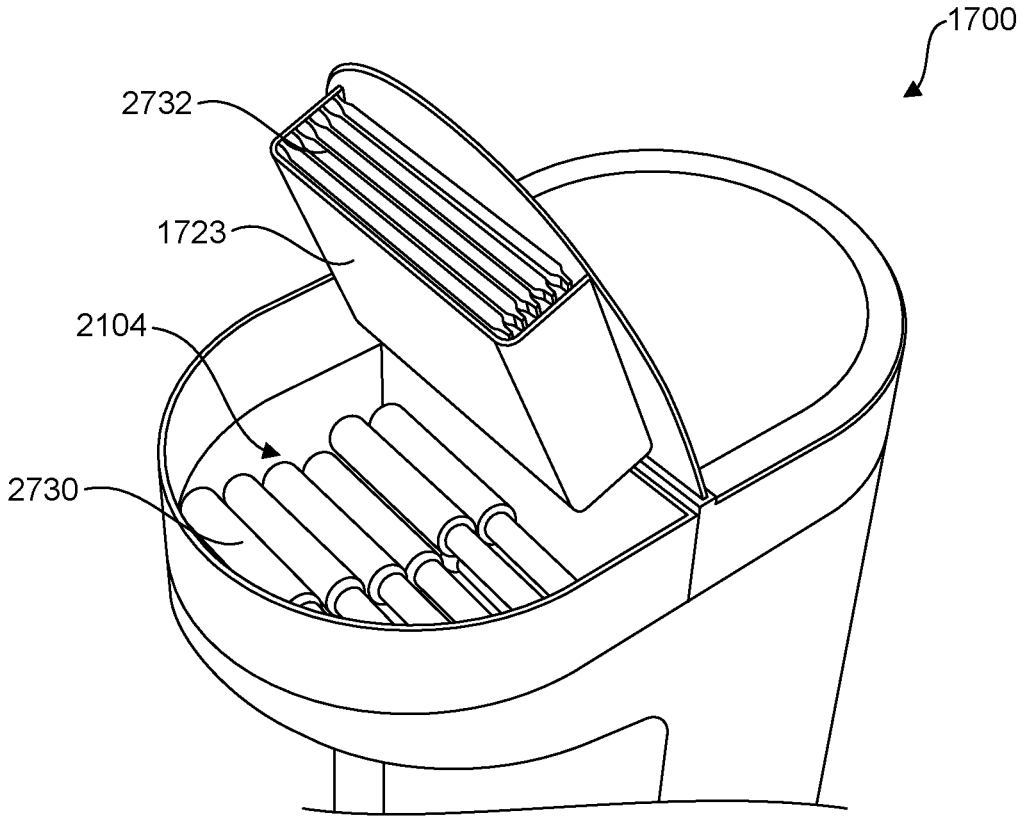
FIG. 28D is a close up top perspective view illustration of the example device of FIG. 26, in use with the rear lid open.
Figure 28E:
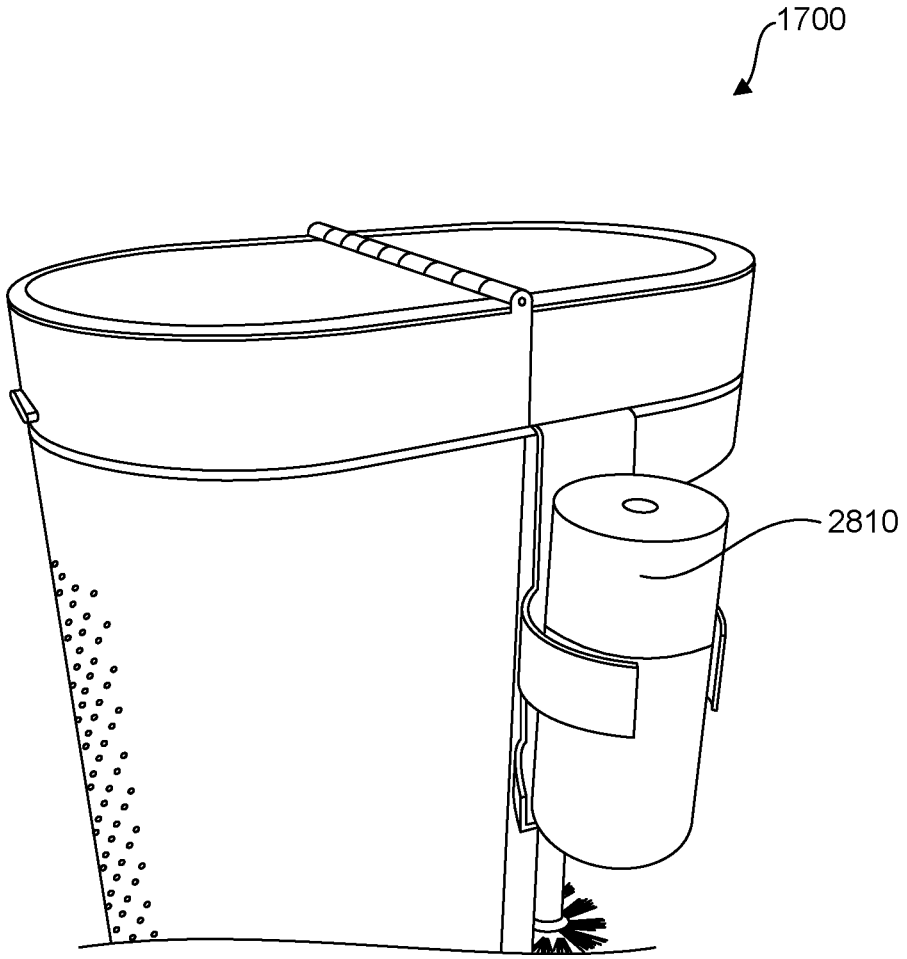
FIG. 28E is a close up side perspective view illustration of the example device of FIG. 26, showing side caddy in use holding an air freshener.

FIG. 28B through FIG. 28D show different perspective views of an example storage device having compartments 1730, 2102, and 2104 in use storing toilet paper 2710, wipes 2720, and feminine sanitary products 2731/2730, respectively. FIG. 28E shows an example air freshener spray 2810 held within a caddy in accordance with an example embodiment.

III. CONCLUSION

The foregoing description illustrates various embodiments along with examples of how aspects of the systems may be implemented. The above examples and embodiments should not be deemed to be the only embodiments, and are presented to illustrate the flexibility and advantages of the systems. In the figures, similar symbols typically identify similar components, unless context dictates otherwise. Other embodiments can be utilized, and other changes can be made, without departing from the spirit or scope of the subject matter presented herein. It will be readily understood that the aspects of the present disclosure, as generally described herein, and illustrated in the figures, can be arranged, substituted, combined, separated, and designed in a wide variety of different configurations, all of which are explicitly contemplated herein.

While various aspects and embodiments have been disclosed herein, other aspects and embodiments will be apparent to those skilled in the art. The various aspects and embodiments disclosed herein are for purposes of illustration and are not intended to be limiting.

What is claimed is:

1. An apparatus for storing bathroom accessories, comprising;

a main body;

an upper compartment assembly secured at a top end of the main body; and a base secured at a bottom end of said main body, wherein:

the upper compartment assembly includes a front compartment body and front lid defining a front compartment, and a rear lid covering a rear compartment defined at least in part by a dividing member, and the main body includes a central storage compartment defined at least in part by a front wall, the dividing member, and the front compartment body of the upper compartment assembly.

2. The apparatus of claim 1, wherein the main body comprises the front wall, a frame, and the dividing member disposed between the frame and the front wall, wherein the dividing member includes a substantially vertical rear wall portion that defines a rear wall of the central storage compartment and a substantially horizontal portion that defines a bottom of the central storage compartment.

3. The apparatus of claim 2, wherein the rear lid includes a holder disposed on a bottom surface of the rear lid.

4. The apparatus of claim 2, further comprising a removable tray configured and dimensioned to fit over said base and support a head of a plunger within the frame or said body.

5. The apparatus of claim 4, further comprising a clip member configured and dimensioned to secure to a handle of the plunger and to a handle of a brush, wherein the brush is supported by the plunger when the clip is so secured.

6. The apparatus of claim 2, further comprising one or more caddies for storing accessories.

7. The apparatus of claim 6, wherein the accessories are any of an air freshener, a cell phone, an e-book, a book, a magazine, a music player, a speaker, tissues, tampons, sanitary napkins, cigarettes, matches, perfume, or toiletries.

8. The apparatus of claim 7, wherein body further comprises one or more attachment members for attaching the one or more caddies.

9. The apparatus of claim 8, wherein the one or more attachment members comprise one or more slots configured to receive one or more hooks on each caddy.

* * * * *